US007325507B1

(12) United States Patent
Hundertmark

(10) Patent No.: US 7,325,507 B1
(45) Date of Patent: Feb. 5, 2008

(54) TILLER OPERATED MARINE STEERING SYSTEM

(75) Inventor: James M. Hundertmark, Fond du Lac, WI (US)

(73) Assignee: Mark X Steering Systems LLC, Oshkosh, WI (US)

( * ) Notice: Subject to any disclaimer, the term of this patent is extended or adjusted under 35 U.S.C. 154(b) by 0 days.

(21) Appl. No.: 11/139,795

(22) Filed: May 27, 2005

(51) Int. Cl.
*B63H 25/22* (2006.01)

(52) U.S. Cl. ..... 114/150; 114/172; 440/61 S; 440/61 A

(58) Field of Classification Search ..... None
See application file for complete search history.

(56) References Cited

U.S. PATENT DOCUMENTS

| | | | | |
|---|---|---|---|---|
| 2,927,551 | A | 3/1960 | Bevis et al. | |
| 2,947,278 | A | 8/1960 | Magill et al. | |
| 3,039,420 | A | 6/1962 | Bevis et al. | |
| 3,148,657 | A * | 9/1964 | Horning | 440/55 |
| 3,631,833 | A | 1/1972 | Shimanckas | |
| 3,658,027 | A | 4/1972 | Sturges | |
| 3,796,292 | A | 3/1974 | Harrison | |
| 4,227,481 | A | 10/1980 | Cox et al. | |
| 4,557,695 | A | 12/1985 | Neisen | |
| 5,105,924 | A | 4/1992 | Carlson | |
| 5,349,818 | A * | 9/1994 | McFadyen et al. | 60/385 |
| 5,423,277 | A | 6/1995 | Gai | |
| 6,341,992 | B1 | 1/2002 | Eglinsdoerfer et al. | |
| 6,715,438 | B1 | 4/2004 | Hundertmark | |

* cited by examiner

*Primary Examiner*—Sherman Basinger
(74) *Attorney, Agent, or Firm*—Boyle Fredrickson S.C.

(57) ABSTRACT

A tiller-based watercraft steering system is responsive to tiller release to lock a watercraft's steered element in the last commanded position upon tiller release. The system is locked by closing a valve assembly to prevent flow to opposed chamber of a hydraulic lock coupled to the steered element. The tiller preferably comprises an actuator portion which is movable relative to the remainder of the tiller. The actuator portion may, for example, be a grip on an articulating outer end portion of a tiller arm. The valve assembly may be connected to the hydraulic lock to form a combined module. It may be actuated by a mechanical link such as one or more cables leading from the actuator portion of the tiller to the valve assembly. The system may be used as either a manual or a power-assisted steering system.

9 Claims, 21 Drawing Sheets

TILLER OPERATED MARINE STEERING SYSTEM

BACKGROUND OF THE INVENTION

1. Field of the Invention

The invention relates to marine steering systems and, more particularly, relates to a steering system for a boat or other watercraft that is powered by a motor and steered by a tiller. Specifically, the invention relates to a tiller-operated steering system that is self-locking upon tiller release so as to immunize the tiller from reaction forces that would otherwise be imposed on the tiller by the motor or other steered element. The watercraft's steered element therefore retains the last steering angle commanded upon tiller release.

2. Discussion of the Related Art

In one type of conventional marine steering system, a watercraft such as a boat is steered by pivoting an outboard motor on the stem of the watercraft about a vertical steering axis under control of an operator. The steering forces are typically generated manually using a tiller that is located at the stem of the boat and that is connected to the motor either directly or indirectly via a mechanical steering linkage.

Reaction forces are imposed on and/or by the motor or other steered element during normal operation of the typical boat. These reaction forces may cause the steering angle to change unless the reaction forces are countered by the operator. The operator must therefore retain control of the tiller at all times in order to maintain a desired steering angle. The operator's freedom of movement therefore is sharply curtailed. In addition, the reaction forces increase generally proportionately with motor size. The relatively large reaction forces imposed on and by larger motors require commensurately larger retention forces by the operator, leading to operator fatigue over time.

Several proposals have been made to incorporate features into a marine steering system to prevent reaction or backlash forces imposed on or by the motor or other steered element from being translated back to the tiller. Most of these systems take the form of a wrapped spring brake or similar mechanical lock that acts on a steering shaft assembly or other rotational steering system component. The mechanical lock releases automatically when steering forces are imposed on one end of the rotational component so as to permit rotation of that component for the purpose of changing the steered element's steering angle. The lock engages automatically when backlash or reaction forces are transmitted to the opposite end of the rotational component, thereby locking the component from rotation and maintaining the last commanded steering angle of the steered element. Systems of this type are disclosed, for example, in U.S. Pat. No. 2,927,551 to Bevis; U.S. Pat. No. 2,947,278 to Magill; U.S. Pat. No. 3,039,420 to Bevis; and U.S. Pat. No. 3,796,292 to Harrison.

Others have proposed the coupling of a watercraft's steered mechanism to a hydraulic cylinder whose piston is locked from motion upon release of the steering mechanism so as to lock the rudder or other steered element in position and, thereby prevent backlash forces from being transmitted back to the steering mechanism. Systems of this type are disclosed, for example, in U.S. Pat. No. 3,631,833 to Shimanckas; U.S. Pat. No. 3,658,027 to Sturgis; U.S. Pat. No. 4,227,481 to Cox; and U.S. Pat. No. 4,557,695 to Neissen.

However, all of the self-locking steering systems described above are rather complex and cannot be easily installed without substantial modification to the existing steering system. Most of these systems are configured exclusively for use with a helm-based steering system rather than a tiller-based steering system. None is configured to be easily incorporated into an existing tiller-based steering design or retrofitted onto a pre-manufactured tiller-based steering system.

Perhaps as a result of these deficiencies, the prevailing approach used by engine manufacturers utilizes a friction based system, located between the tilt tube for an outboard engine and a tiller, and operable to resist tiller movement. The degree of resistance can be adjusted by manually adjusting a knob. While such friction-based devices reduce the transfer of forces on the tiller, they also hinder tiller operation. They also are necessarily limited in the capacity to block the tiller against undesired movement. They also tend to wear with time, requiring frequent readjustment to maintain the desired resistance.

The need therefore has arisen to provide a simple, effective, self-locking tiller operated power assist steering system that maintains a steering angle against reaction forces on or by the steered element, thereby negating the need for the operator to constantly man the tiller.

The need has additionally arisen to provide a self-locking system that can be incorporated into an existing tiller-based steering system with no more than minimal modification to the existing steering system design.

SUMMARY OF THE INVENTION

In accordance with one aspect of the invention, a mechanical/hydraulic system that is responsive to tiller release to lock a watercraft's steered element in the last commanded position. The tiller preferably comprises an actuator portion which is movable relative to the remainder of the tiller. The actuator portion may, for example, be an articulating outer end portion of a tiller arm.

Regardless of the drive mechanism and actuator employed, the actuator portion preferably serves as an actuator that actuates a valve assembly to permit fluid to flow between chambers of a hydraulic cylinder upon actuator portion articulation to permit unrestricted motion of the tiller and the steered element. The valve assembly closes automatically upon tiller release to isolate the cylinder chambers from one another and lock the steered element in the last commanded position. The operator is then free to release the tiller and perform other activities.

The valve assembly is preferably connected to the hydraulic lock to form a combined module and actuated by a mechanical link such as one or more cables leading from the actuator portion of the tiller to the valve assembly.

A method of operating a tiller fitted with a mechanical/hydraulic locking system is also provided.

These and other advantages and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. System Overview

Figure 1:
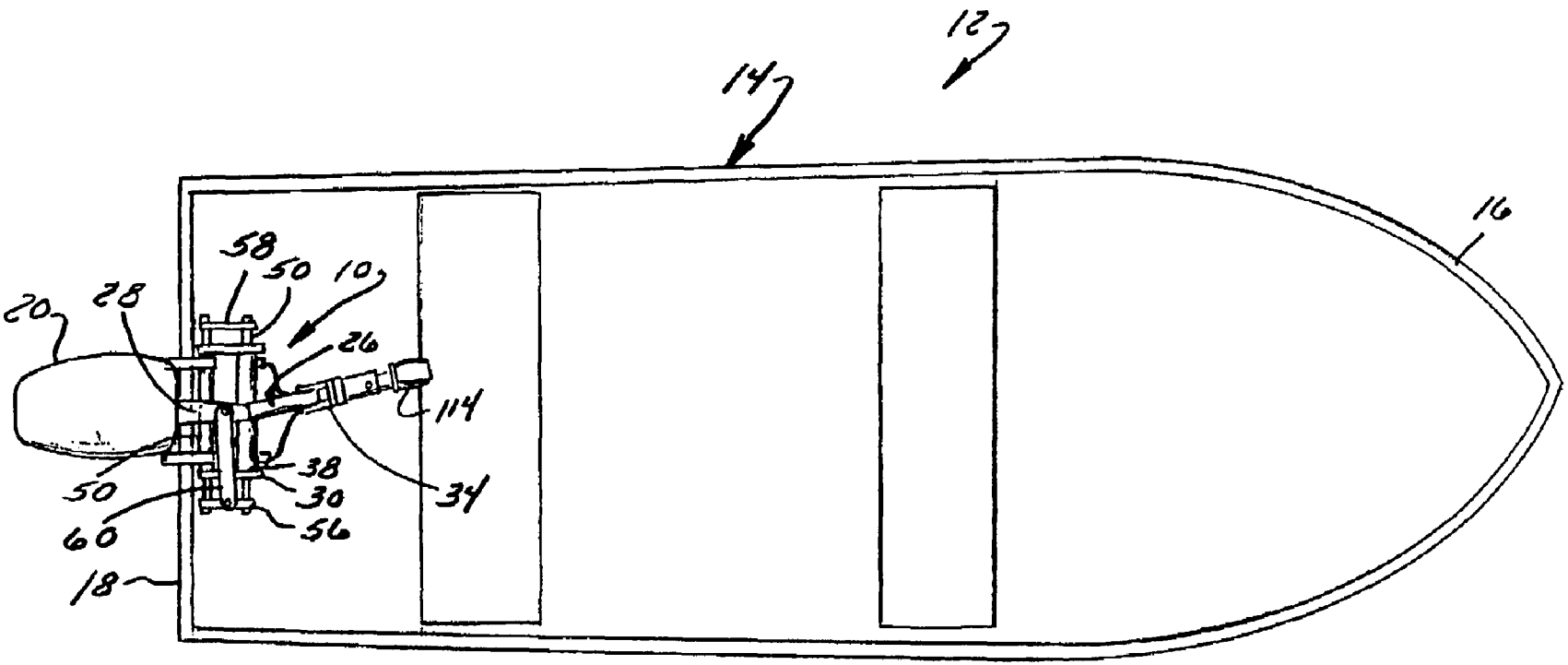
FIG. 1 is a schematic top plan view of a boat incorporating a self-locking tiller-operated steering system constructed in accordance with a first preferred embodiment of the present invention.
Figure 2:
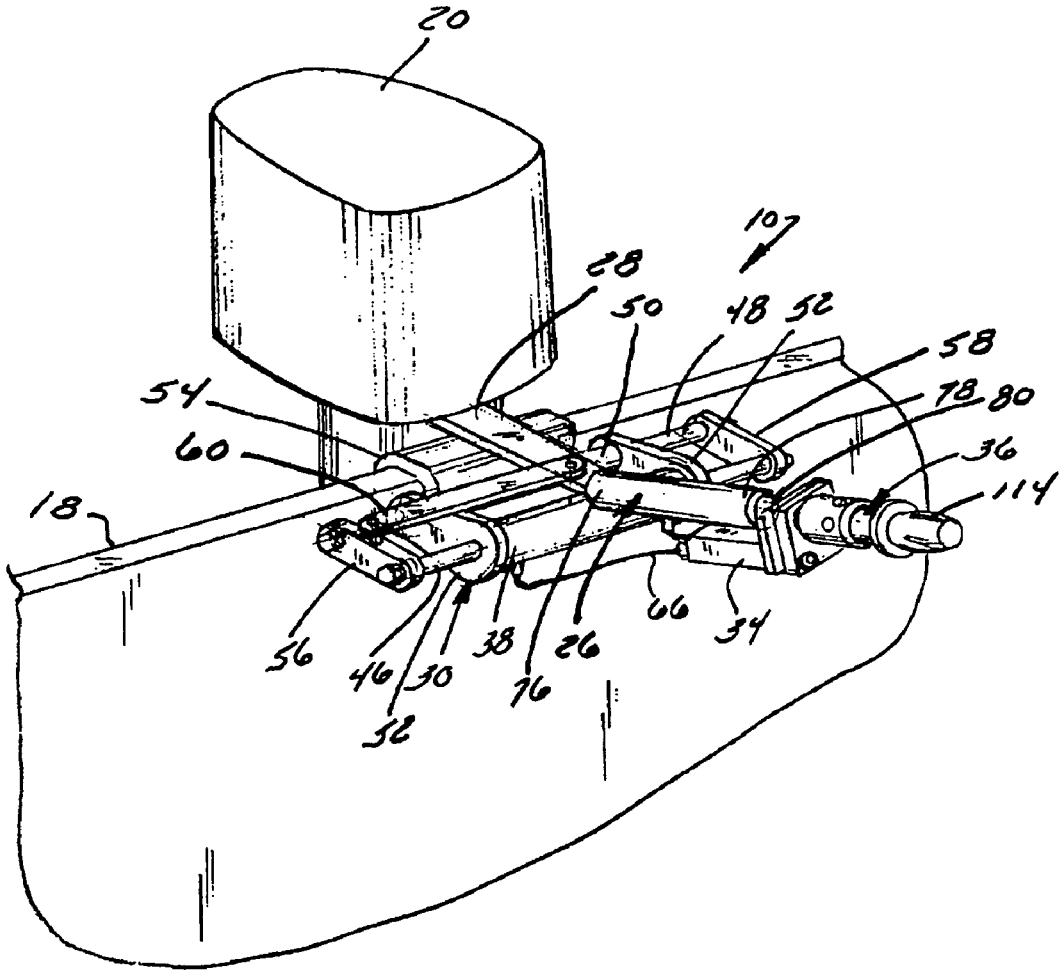
FIG. 2 is a perspective view of the steering system of FIG. 1 and of the surrounding portion of the boat.
Figure 3:
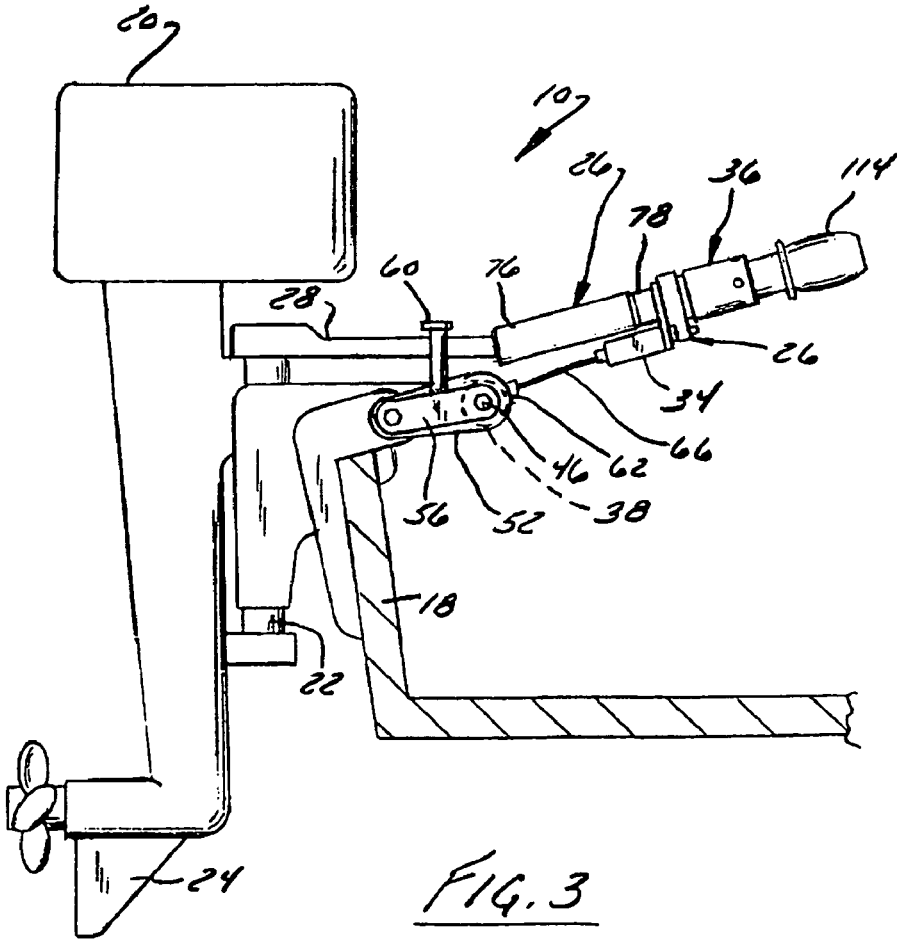
FIG. 3 is a side elevation view of the stem of the boat, showing the engine and steering system mounted on the stern.

Turning now to the drawings and initially to FIGS. 1-3, a boat 12 is illustrated that incorporates a self-locking tiller-operated steering system 10 constructed in accordance with a preferred embodiment of the present invention. The boat 12 includes a hull 14 having a bow 16 and a stem formed by a transom 18, and an outboard motor 20 mounted on the transom 18. As is conventional, the motor 20 is mounted on the boat 12 by a pivoting mount assembly 22 that permits the motor 20 to be pivoted about a generally vertical steering axis to cause a rudder 24 on the motor 20 to steer the boat 12 as best seen in FIG. 3. The motor 20 could alternatively be a non-pivoting inboard or outboard motor, and the boat 12 or other watercraft could be steered by one or more rudders located either on or remote from the motor 20.

Steering forces are transmitted to the motor 20 by a tiller 26. The tiller 26 is coupled to the motor by a steering arm 28 that causes the motor 20 to swing about its pivot axis when steering forces are applied to the tiller 26. The steering arm 28 has a first end fixed to the motor's pivot shaft 22 and a second end that is operatively coupled to the tiller 26. Alternatively, the tiller 26 could be operatively coupled to the motor 20 by a cable arrangement or some other structure permitting the tiller 26 to be located remote from the motor 20. The tiller 26 could also be mounted directly on or formed integrally with the motor 20 or a stand-alone rudder.

The steering system 10 is configured to be self-locking. That is, it incorporates a hydraulic lock that is automatically engaged upon tiller release or a lack of input from the operator to prevent reaction forces imposed on or by the rudder 24 from being transmitted back to the tiller 26 and thereby maintaining the last commanded steering angle. The hydraulic lock automatically disengages upon the imposition of manual steering forces on the tiller 26 to permit manual steering. Hydraulic lock engagement and disengagement is controlled by actuation of a valve assembly 32 that reacts to tiller actuation, preferably by articulation of an actuator portion of the tiller relative to the remainder of the tiller, to prevent fluid flow to and from the hydraulic lock. The hydraulic lock preferably comprises a hydraulic cylinder assembly having a piston that can be locked in position by preventing fluid flow to and from cylinder chambers located on opposite sides of the piston. The system requires minimal, if any, modification to the existing tiller design. In fact, embodiments of the system are available that can be retrofitted onto an existing tiller without substantial modification to the tiller.

Three exemplary self-locking steering systems will now be described by way of non-limiting examples of steering systems constructed in accordance with the invention.

2. Construction and Operation of First Embodiment

Figure 4:
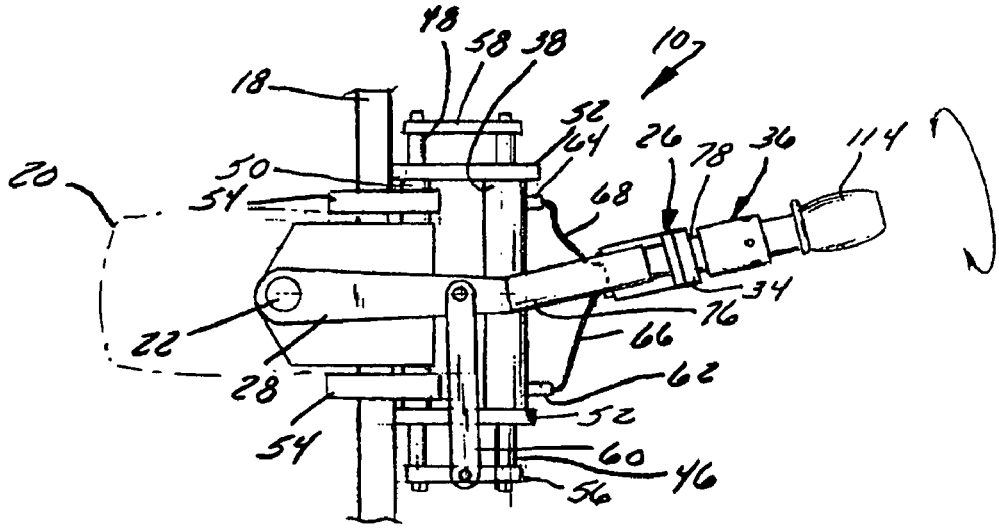
FIG. 4 is top plan view of the steering system of FIG. 2.

Turning now to FIGS. 2-7B and initially to FIGS. 2-4, a self-locking tiller actuated steering system 10 constructed in accordance with the first preferred embodiment of the invention include the above-described tiller, a hydraulic lock in the form of a cylinder assembly 30, and a valve assembly 32 that is housed in a valve unit 34 mounted on the underside of the tiller 26. The valve assembly 32 is responsive to tiller operation to selectively engage and disengage the hydraulic lock by selectively permitting or preventing a movable portion of the cylinder assembly 30 from moving. More specifically, the valve assembly 32 is actuated in response to movement of an actuator portion 36 of the tiller 26 relative to another portion of tiller from a neutral position thereof in order to permit fluid to flow to and from the hydraulic cylinder assembly 30 to disengage the lock and permit movement of the portion of the tiller 26 that is coupled to the systems arm 28. The valve assembly 32 is deactuated in response to release of the tiller 26 or a lack of input from the operator and return of the tiller actuator portion 36 to its neutral position to prevent fluid from flowing to or from the cylinder assembly 30 to engage the lock and prevent tiller movement, thereby preventing reaction forces imposed on or by the motor 20 from being transmitted to the tiller 26 and maintaining the last commanded steering angle of the rudder 24. The hydraulic cylinder assembly 30, tiller 26, and valve assembly 32 will now be described in turn.

Figure 5:
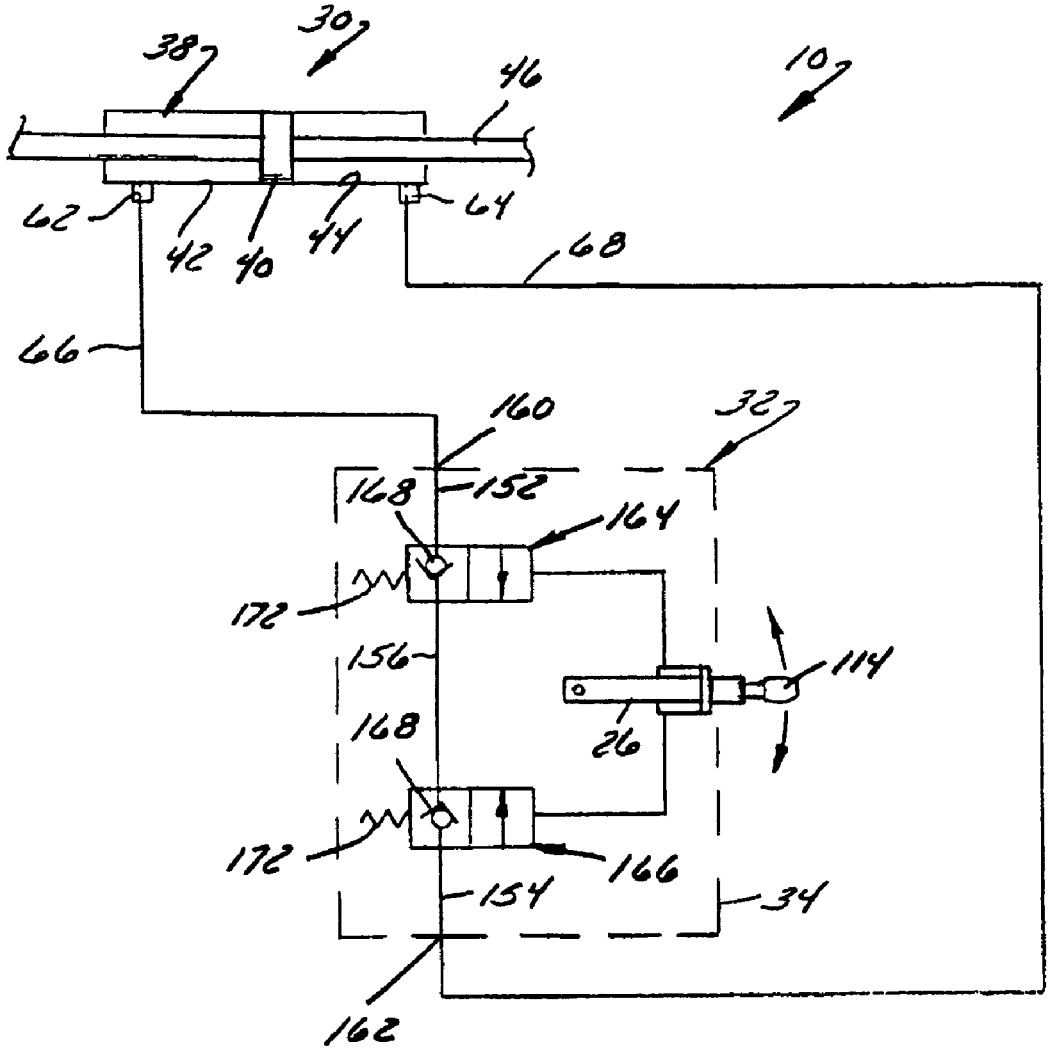
FIG. 5 is a hydraulic circuit schematic illustrating the construction and operation of the hydraulic components of the steering system of FIGS. 2-4.

Referring now to the mechanical drawings of FIGS. 2-4 and to the hydraulic schematic of FIG. 5, the hydraulic cylinder assembly 30 includes a cylinder 38, a balanced piston 40 that is mounted in the cylinder 38 to define first and second chambers 42 and 44 on opposite sides thereof, and a rod 46 that is affixed to the piston 40 and that extends through both ends of the cylinder 38. Pursuant to the invention, one of the rod 46 and the cylinder 38 is movable relative to the other and is connected to the steering arm 28, and the other of the rod 46 of the cylinder 38 is mounted on a fixed support such as the transom 18 or on an intervening mounting assembly. In the illustrated embodiment, the rod 46 is coupled to the steering arm 28, and the cylinder 38 is mounted on the transom 18. Specifically, a guide rod 48 is slidably mounted in a guide and support sleeve 50 so as to extend laterally along the inside surface of the transom 18 in front of the motor 20. The cylinder 38 is located in front of the sleeve 50 and is fixed to the sleeve 50 by a pair of laterally spaced, longitudinally extending links 52. The assembly formed by the sleeve 50 and the cylinder 38 is clamped to the transom 18 by clamp brackets 54 located on opposite sides of the motor 20. The opposed ends of the rod 46 are linked to the guide rod 48 by a pair of laterally spaced, longitudinally extending links 56 and 58. The link 56 is coupled to the steering arm 28 by a pivot arm 60. Specifically, pivot arm 60 has a first end pivotally attached to the first link 56 and a second end pivotally attached to the steering arm 28 between the tiller 26 and the pivot shaft 22.

As best seen in FIGS. 2 and 5, the first and second chambers 42 and 44 in the cylinder 38 have corresponding first and second ports 62 and 64 that are coupled to first and second hydraulic lines 66 and 68. The lines 66 and 68 convey hydraulic fluid between the chambers 42 and 44 and the valve assembly 32. As a result of this arrangement, tiller pivoting motion causes the steering arm 28 to swing in the direction of the arrow in FIG. 4, resulting in corresponding movement of the cylinder rod 46 and guide rod 48 relative to the fixed sleeve 50 and the cylinder 38. When the hydraulic lock is engaged by preventing fluid flow to and from the cylinder 38 to prevent the piston 40 and rod 46 from moving relative to the cylinder 38, the pivot arm 60 is locked in place, thereby locking the steering arm 28 and the tiller 26 in place and maintaining the last commanded steering angle of the rudder 24.

Referring to FIGS. 2-4 and 6, the tiller 26 includes a hollow tiller arm 70 and a throttle shaft 72. The throttle shaft 72 extends through the hollow interior of the tiller arm 70. It has a proximal, inner end borne in the hub of a throttle cable drive pulley (not shown). It also has a distal front end 74 that is splined to the tiller actuator portion 36. The tiller arm 70 extends from a rear, proximal end 76 affixed to the steering arm 28 to a front, distal end 78. The front end 78 has a reduced diameter portion 80 that supports a valve actuator 82 and the valve body 34.

Figure 6:
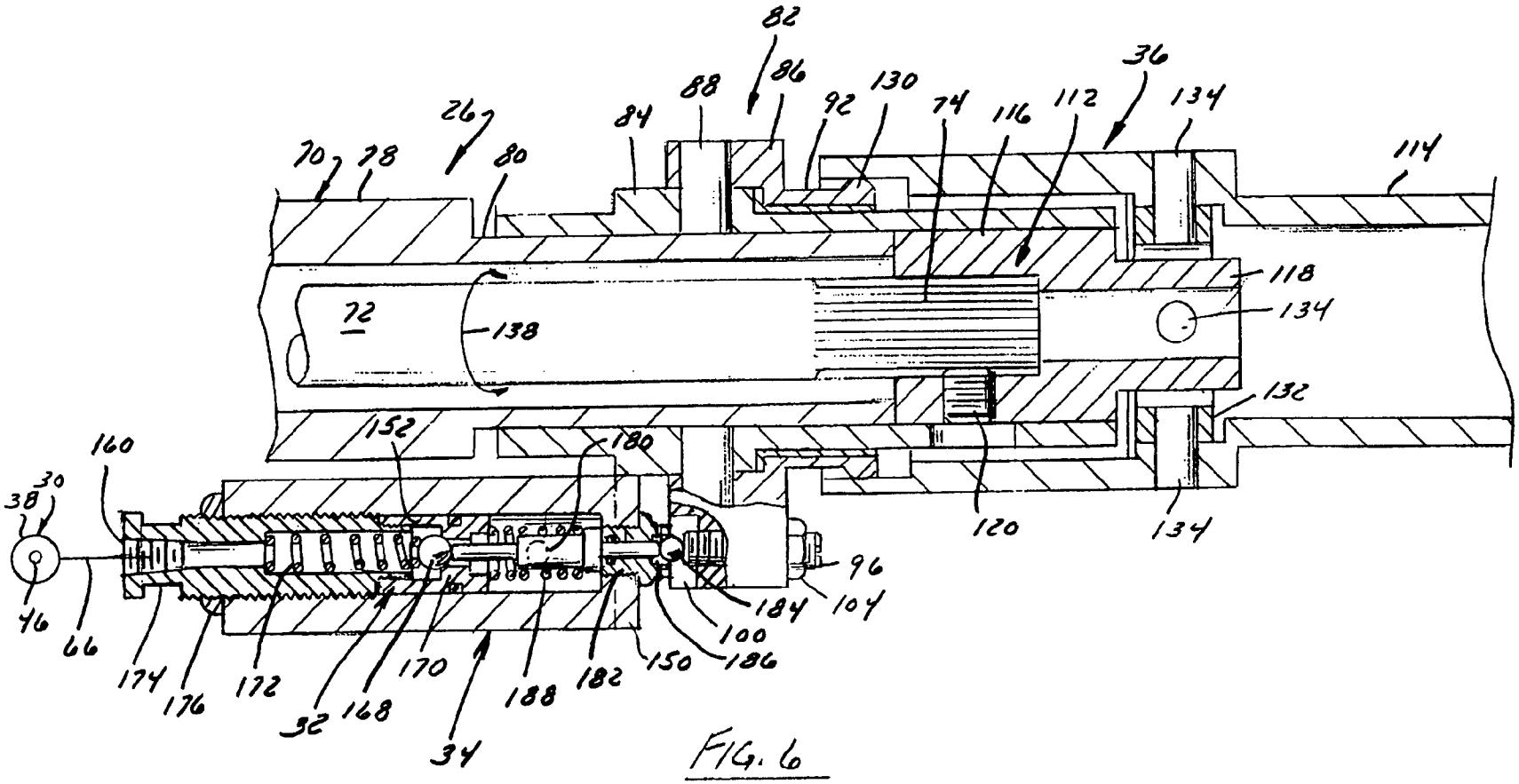
FIG. 6 is a sectional elevation view of a portion of a tiller of the steering system of FIGS. 2-4 that includes a valve actuator and valve assembly of the steering system.
Figure 7A:
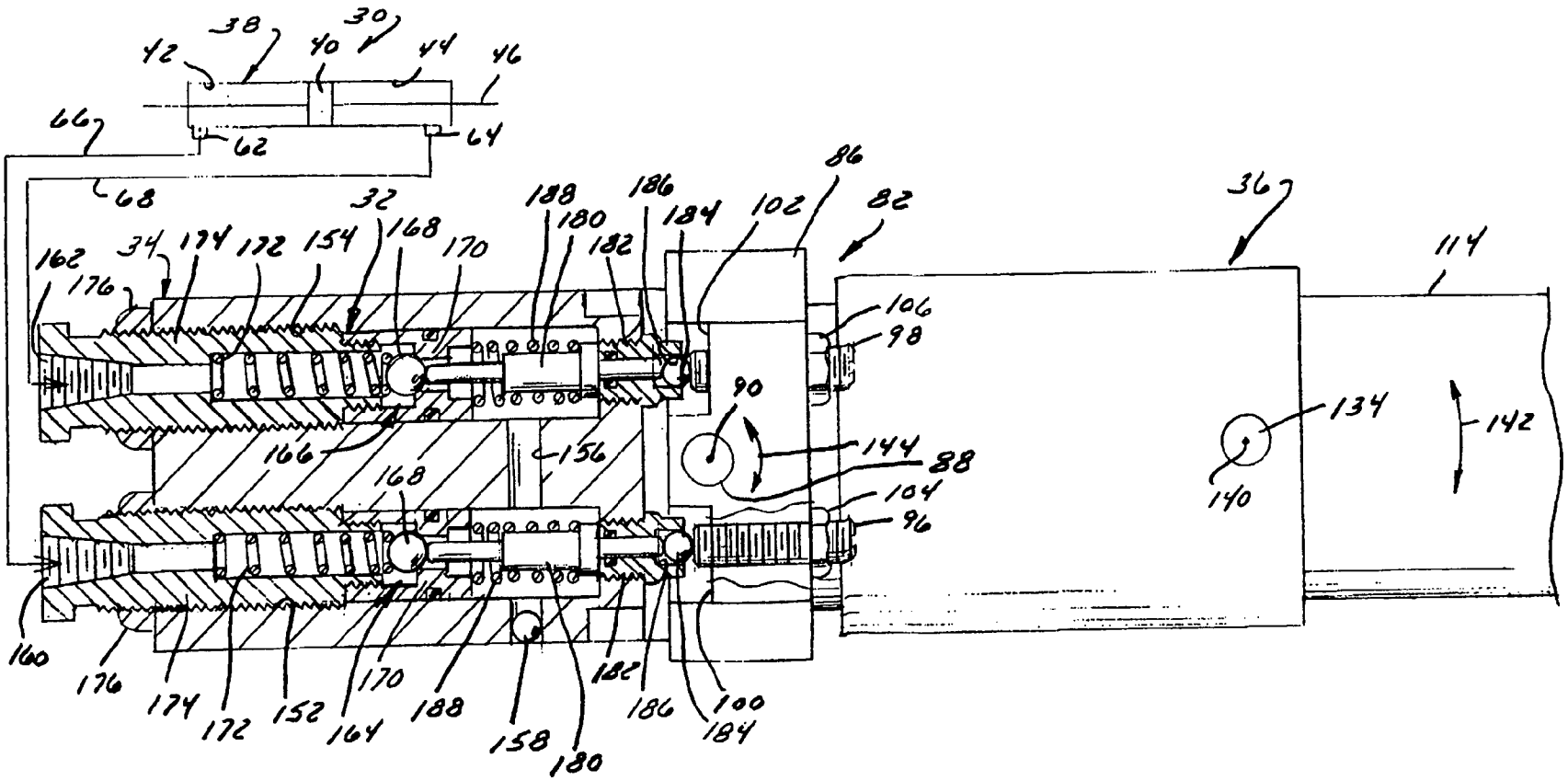
FIG. 7A is a sectional bottom plan view of the steering system portion of FIG. 6, showing the valve actuator in a first operational position thereof.

The valve assembly 32 is actuated by a valve actuator 82 that is responsive to tiller actuator portion movement. Referring now to FIGS. 6 and 7A, the valve actuator 82 is mounted on the first end of the tiller arm 70 so that a portion thereof is pivotable from a neutral position thereof through a limited stroke relative to the tiller arm 70 to actuate the valve assembly 32. The valve actuator 82 includes an actuator support sleeve 84 and an actuator block 86 that is pivotably mounted on the actuator support sleeve 84. The actuator support sleeve 84 has a rear end that surrounds the reduced diameter front portion 80 of the tiller arm 70 and a front end that extends beyond the front end 78 of the tiller arm 70. The actuator block 86 comprises a metal block mounted on the actuator support sleeve 84 by swivel pins 88 so as to be capable of pivoting about a pivot axis 90 in the direction of the arrow in FIG. 7A. A guide collar 92 extends forwardly from the body of the actuator block 86 for guiding the throttle grip 114 as detailed below.

Referring particularly to FIG. 7A, first and second drive pins 96 and 98 are threaded through tapped bores located on opposite sides of the pivot axis 90 of the actuator block 86 and into counterbores 100 and 102 located at the rear surface of the actuator block 86. The position of the rear end of each drive pins 96 and 98 relative to the rear surface of the actuator block 86 can be adjusted by threading the drive pin 96 or 98 into or out of the associated bore and locking the drive pin in place with a lock nut 104 or 106.

Referring to FIG. 6, the tiller actuator portion 36 of this embodiment comprises a throttle grip assembly mounted on the end of the throttle shaft 72. The throttle grip assembly comprises a grip support tube 112 and a throttle grip 114 mounted on the grip support tube 112. The grip support tube 112 has a relatively large diameter rear portion 116 and a relatively small diameter front portion 118. The exterior of the rear portion 116 is guided by the extension of the actuator support sleeve 84, and the interior of the of the rear portion 116 is splined to the front end 74 of the throttle shaft 72 and held against the throttle shaft 72 by a set screw 120. The throttle grip 114 is hollow so as to be mountable over the grip support tube 112, the extension of the actuator support sleeve 84, and the collar 92 of the actuator block 86. The rear end of the throttle grip 114 engages and is guided by an annular rib 130 on the front end of the guide collar 92. The throttle grip 114 is pivotally mounted on the front end portion 118 of the grip support tube 112 by a universal joint 132 and corresponding universal joint pins 134. With this arrangement, the throttle grip 114 can rotate relative to the tiller arm 70 to rotate the throttle shaft 72 in the direction of the arrow 138 in FIG. 6 to actuate the throttle. It can also pivot about a vertical pivot axis formed by the universal joint pins 134 to actuate the valve assembly 32. The relationship between the universal joint 132 and the swivel pins 88 causes the actuator block 86 and throttle shaft 72 to pivot in opposite directions. Hence, clockwise throttle shaft pivoting in the direction of arrow 142 in FIG. 7B results in counterclockwise actuator block pivoting in the direction of arrow 144, and vice versa.

Referring to FIGS. 5, 6, and 7A, the valve body 34 is mounted on the tiller arm 70 proximate the first end of the tiller arm, preferably by being affixed to a lateral plate 150 on the bottom surface of the actuator support sleeve 84. The valve body 34 has first and second longitudinal through bores 152 and 154 that house the valve assembly 132. It also has a cross passage 156 connecting the bores 152 and 154 to one another. The cross passage 156 is drilled into the valve body 34 from its lower surface and closed at the bottom end by a plug 158. The rear ends of the bores 152 and 154 from first and second inlet/outlet ports 160 and 162 are connected to the corresponding ports 62 and 64 in the cylinder 38 by the hydraulic lines 66 and 68.

The valve assembly 32 comprises first and second control valves 164 and 166 that are identical in construction. The control valve 164 will now be described, it being understood that the description applies equally to the valve 166. Control valve 164 includes check ball 168 located adjacent a seat 170 positioned generally centrally of the bore 152 behind the cross passage 156. The check ball 168 is biased against the seat 170 by a relatively weak return spring 172 that seats against the check ball 168 at its forward end and against a spring seat at its rear end. The spring seat is formed by a step in a bore in a fitting 174 threadedly into the rear end of the bore 152. Fitting 174 is internally threaded at its rear end for connection to the hydraulic line 66. It can be rotated to adjust the distance between check ball 168 and actuator pin 180.

The opening force for the check ball 168 can be generated either by pressure in the cross passage 156 or by an actuator pin 180 that is driven by drive pin 96. The actuator pin 180 extends longitudinally forwardly from the check ball 168 and into an actuator guide 182 threaded into the front end of the bore 152. A wear ball 184 is mounted in a recess 186 in the front end of the actuator guide 182 in abutment with the corresponding drive pin 96 of the valve actuator 82. The actuator pin 180 is biased to the position illustrated in FIG. 7A by a relatively strong return spring 188. The return spring 188 also acts through the actuator pin 180, wear ball 184, and drive pin 96 to bias the valve actuator 82 and throttle grip 114 to their neutral, centered positions.

In use, the steering system 10 assumes the position illustrated in FIGS. 5, 6, and 7A in the absence of the imposition of steering forces on the throttle grip 114. At this time, the throttle grip 114 assumes its center or neutral position, and both control valves 164 and 166 assume their illustrated closed position. Fluid flow between the chambers 42 and 44 in the cylinder 38 is blocked by the closed control valves 164 and 166, hence locking the piston 40 from moving. This locking prevents steering arm motion and assures that the tiller 76 and motor 20 retain their position despite the imposition of reaction or backlash forces on or by the motor 20.

Figure 7B:
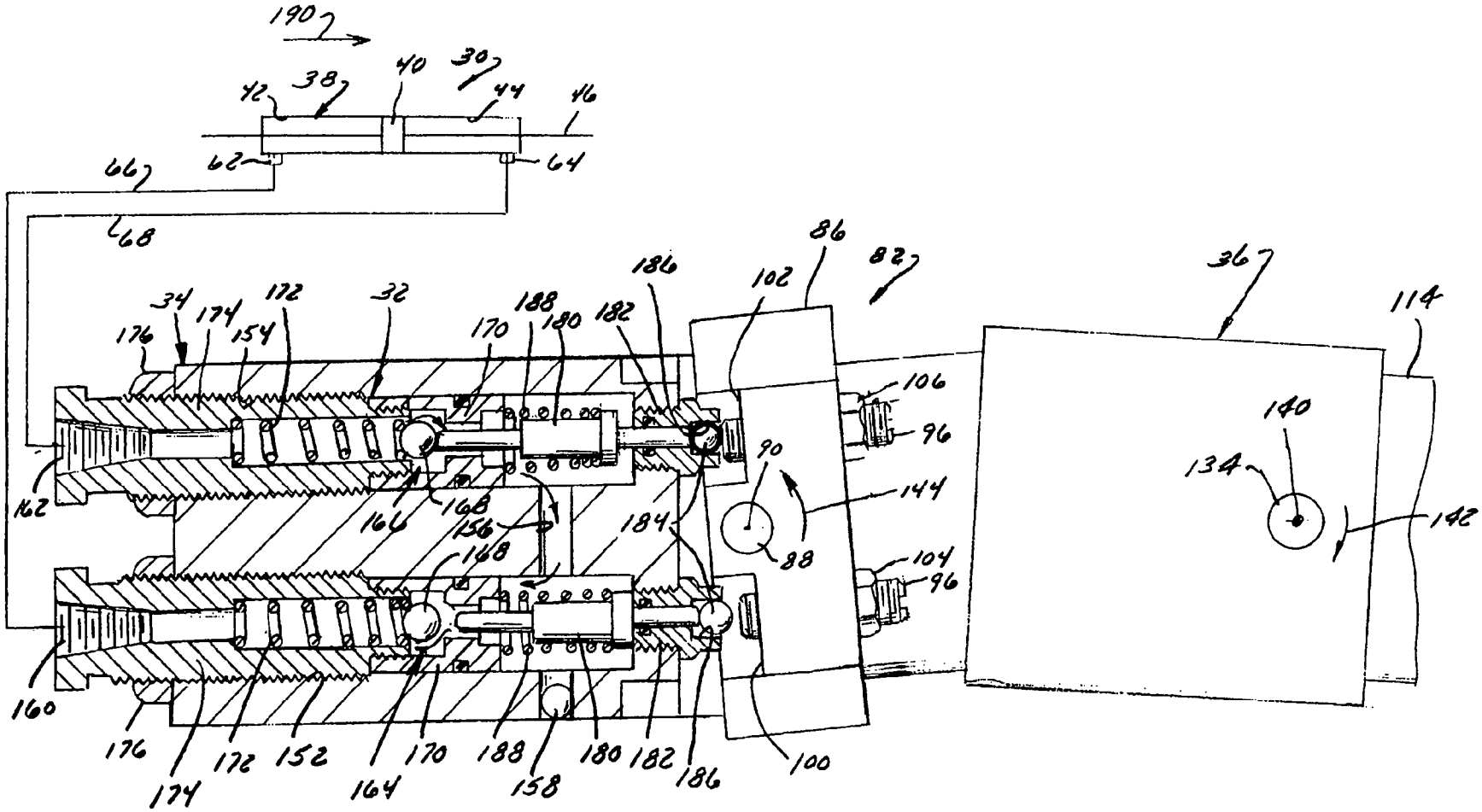
FIG. 7B corresponds to FIG. 7A and shows the valve actuator in a second operational position thereof.

Assuming now that the operator wishes to turn the boat 12 to the right, he or she pivots the throttle grip 114 clockwise as seen in FIG. 7B, thereby moving the actuator block 86 counterclockwise and causing it to open the control valve 166. Additional throttle grip pivoting drives the tiller arm 70 and steering arm 28, hence pivoting the motor 20 about its support 22 and altering the steering angle of the rudder 24. Steering arm movement and resulting cylinder rod movement drives the piston 40 to the right as represented by the arrow 190 in FIG. 7B, forcing fluid from the chamber 44 of the cylinder 38. Fluid then flows through the line 68 and into the port 162, through the valve 166, through the cross passage 156, and into the bore 152. The resulting fluid pressure in the front section of the bore 154 opens the check ball 168 of the valve 164 and permits fluid to flow out of the port 160, through the line 66, and into the opposite chamber 42 of the cylinder 38 via the port 62.

If the operator releases the throttle grip 114, the throttle grip 114 and tiller actuator portion 36 will return to their neutral, center position of FIG. 7A under the force of the actuator pin return spring 188. The check ball 168 of valve 166 will then close under the force of the return spring 172 and any residual fluid pressure across the check ball 168. The check ball 168 of valve 164 will likewise close as soon as the forces imposed on it by the pressure in the cross passage 156 drop below the closing force imposed by the return spring 172. Fluid flow through the valve assembly 32 is now blocked, preventing the piston 40 from moving and locking the motor 20 and its rudder 24 in its last-commanded steering angle. It should be noted that the operator does not need to release the throttle grip to stop the engine movement. If there is a lack of input from the engine, the engine will stop moving when the input from the operator stops. If the tiller 26 is moved in the direction of the torque when the operator input stops, the torque will move the tiller 26 to close the valves.

When steering is required for a left turn, the above operation occurs in the same way but in the opposite direction. Hence, the operator pivots the throttle grip 114 counterclockwise to pivot the actuator block 86 clockwise to open the valve 164 through the line 66. Fluid then flows from the port 62 in the chamber 42 in the cylinder 38, into the port 160, through the open control valve 164, through the cross passage 156, and opens the control valve 166. The fluid then flows out of the port 162 of the valve body 34, through the line 68, and into the opposite chamber 44 of the cylinder 38 via the port 64.

Hence, regardless of the direction of throttle grip movement, one of the control valves 164 or 166 is opened mechanically by an associated drive pin 96 or 98 of the actuator block 86, and the other control valve 166 or 164 is opened by forces arising from the flow of pressurized fluid through the valve body 34.

Valve actuation may be resisted or assisted by reaction forces imposed on or by the motor 20. For instance, if motor torque creates a pressure in the chamber 44 of the cylinder 38 and the operator wants to steer against that torque, he or she will have to impose sufficient force on the tiller 26 to cause the piston 40 to generate sufficient pressure in the opposite chamber 42 to overcome the pressure in the chamber 44 and permit fluid to flow from the chamber 42 to the chamber 44. Conversely, if the engine torque creates a pressure in chamber 44, and the operator wants to steer with the engine torque, he or she moves the throttle grip clockwise with only enough force to pivot the actuator block 186 sufficiently to cause the drive pin 96 to open the control valve 166, at which time the engine torque will drive the piston to the right and cause fluid to flow from the chamber 44, through the valve assembly 32 via the lines 68 and 66, into the opposite chamber 42. Again, as before, once the operator stops the input to the throttle grip 114 the engine torque will return it to its center position, the control valves 164 and 166 close, and all fluid flow and piston movement stops.

3. Construction and Operation of the Second Embodiment

Another embodiment of a self-locking steering system 210 constructed in accordance with the invention is illustrated in FIGS. 8-14. It is usable with the same boat 12 as shown in FIG. 1. It differs from the first embodiment primarily in that a more versatile valve assembly is used that is more easily incorporated into a standard tiller design and, in fact, can be retrofitted onto an existing tiller with little or no tiller modification. It is also illustrated as being used with a different cylinder assembly and steering linkage, but only for the purposes of illustrating the diversity of the invention. Components of the steering system of this embodiment corresponding to components of the first embodiment are designated by the same reference numerals in the drawings, incremented by 200. Hence, the steering system 210 includes a tiller 226, a steering arm 228, a steering cylinder assembly 230, and a valve assembly 232. The valve assembly 232 is housed in a valve body 234 mounted on the tiller 226 actuated by a tiller actuator portion 236.

Figure 8:
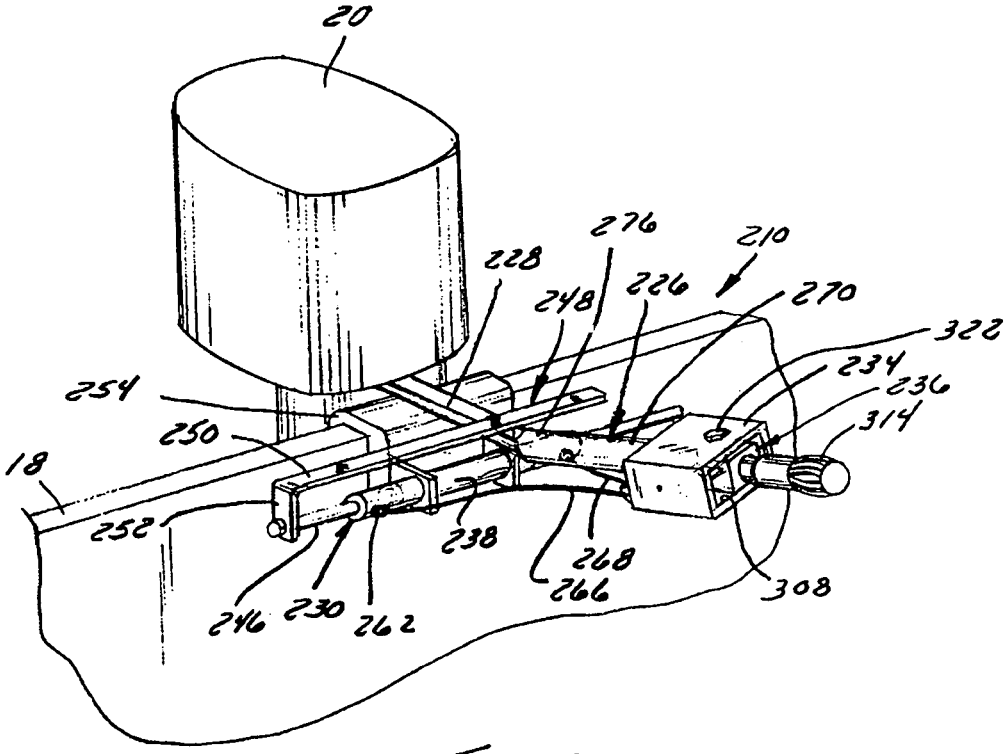
FIG. 8 is perspective view of a steering system constructed in accordance with a second embodiment of the invention and of the surrounding portion of a boat.
Figure 9:
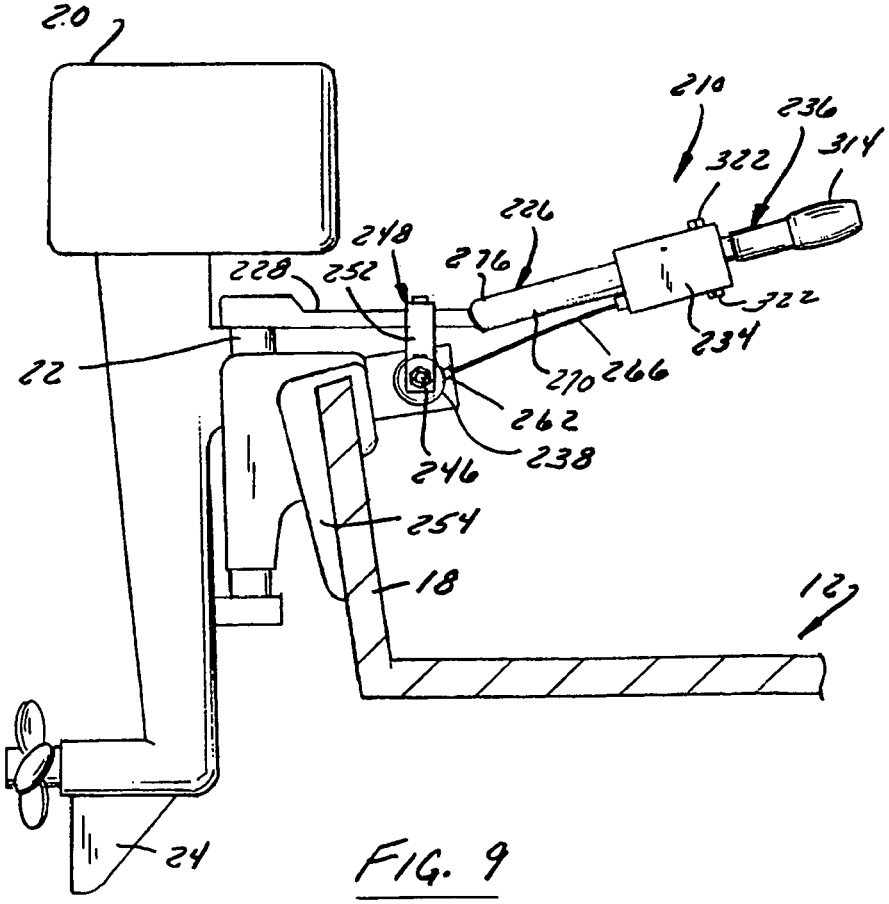
FIG. 9 is a side elevation view of the portion of the boat illustrated in FIG. 8.

The cylinder assembly 230 of this embodiment is functionally identical to the cylinder assembly 30 of the first embodiment. It therefore includes a cylinder 238, a balanced piston 240 disposed in the cylinder 238, and a rod 246 that is attached to the piston 240 to separate the cylinder 238 into first and second chambers 242 and 244. Ports 262 and 264 in the cylinder and connected to the valve body 234 by lines 266 and 268. As best seen in FIGS. 8 and 9, the rod 246 extends completely through the cylinder 238 to terminate at opposed ends extending beyond opposite ends of the cylinder 238. It is coupled to the steering arm 228 by a bracket 248 extending over the steering cylinder. The bracket 248 includes a horizontal portion 250 affixed to the tiller arm 228 at its center, and downwardly angled end 252 affixed to pivot at the end of the rod 246. The cylinder 238 is affixed to the transom 18 of the boat 12 clamp brackets 254 as described above.

Figure 10:
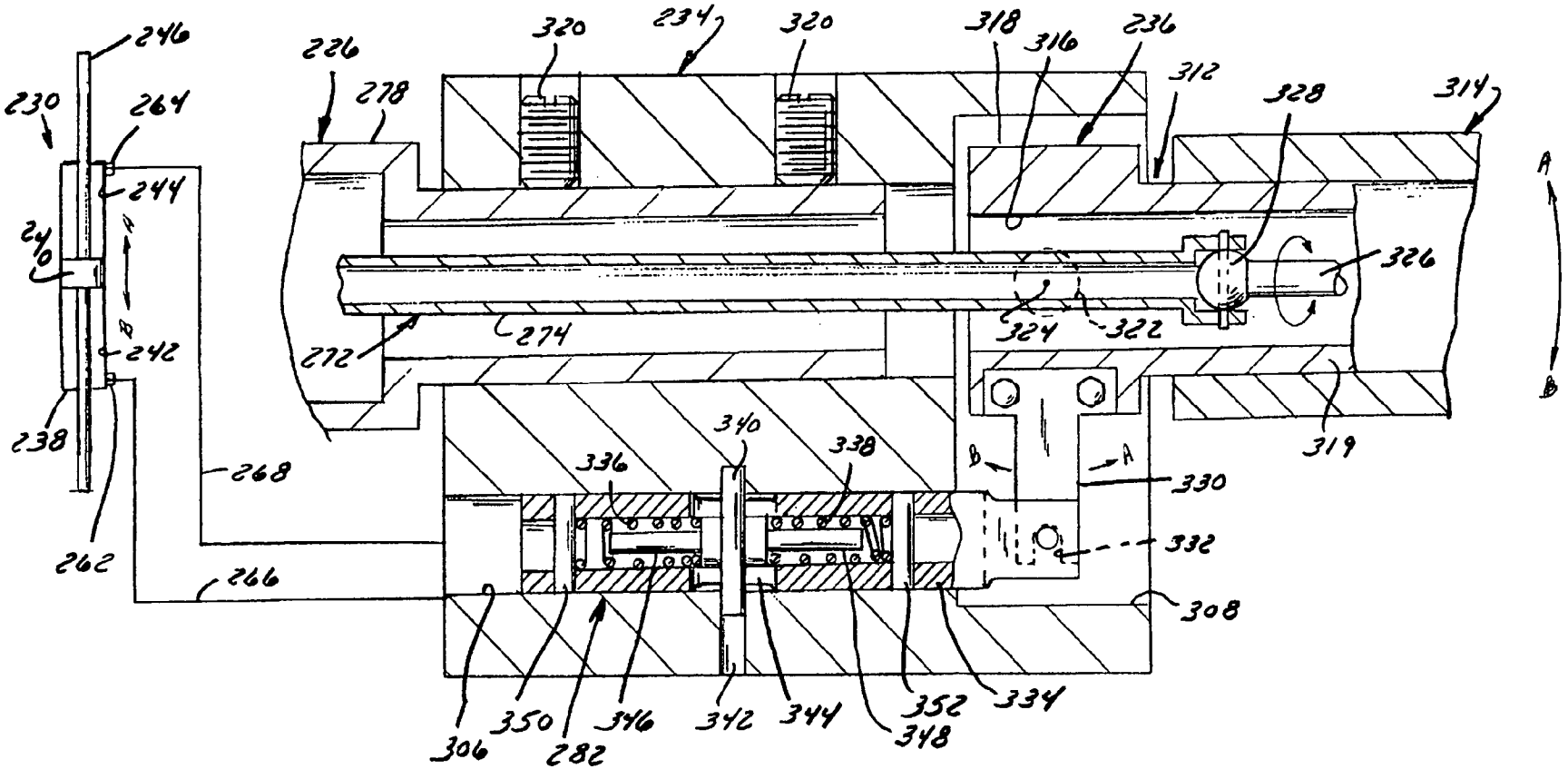
FIG. 10 is a sectional elevation view of a portion of a tiller of the steering system of FIGS. 8 and 9 that includes an actuator portion of the tiller and a valve actuator.

Referring to FIG. 10, the tiller 226 includes a tiller arm 270 and a throttle shaft 272. Throttle shaft 272 extends longitudinally through a hollow interior of the tiller arm 270 to terminate in a front end 274. The tiller arm 270 has rear and front ends 276 and 278. The rear end 276 is affixed to the steering arm 228. The front end 278 supports the valve body 234. The front end 274 of the throttle shaft 272 extends beyond the front end 278 of the tiller arm 270.

The valve body 234 of this embodiment is configured to be mounted on the tiller 226 with little or no tiller arm modification. That is, the front end 278 of the typical tiller arm 270 has a stepped portion 280 for receiving a throttle grip 314, with the throttle grip being affixed to an extension of the tiller shaft that extends beyond the forward distal end of the tiller arm 270. The valve actuator 282 of this embodiment is formed integrally with the valve body 234, which is mounted on the forward distal portion 280 of the tiller arm 270 using suitable set screws 320 as seen in FIG. 10.

The valve actuator 282 of this embodiment is configured to react to throttle grip pivoting in generally the same manner as the valve actuator of the first embodiment. However, it is configured to react progressively and, if desired, nonlinearly to throttle grip pivoting movement as opposed to necessarily reacting linearly to throttle grip pivoting. The valve actuator 282 comprises a cam assembly that is driven to reciprocate linearly relative to the tiller arm 270 upon pivoting movement of a tiller actuator portion 236 relative to the remainder of the tiller 226. The tiller actuator portion 236 and valve actuator (hereafter "cam assembly" 282) will now be described in turn. The cam assembly 282 acts on first and second cam followers 302 and 304, each of which is configured to actuate a control respective valve of the valve assembly 232 under power of the cam assembly 282.

Referring to FIG. 10, the cam assembly 282 is mounted on a relatively large upper throughbore 306 of the valve body 234. The front end of the valve body 234 has a counterbore 308 formed therethrough for receiving the actuator portion 236 of the tiller arm 270. The actuator portion 236 includes a throttle grip adapter 312 and the throttle grip 314. The adapter 312 has a central throughbore 316, a relatively large diameter rear portion 318, and a relatively small diameter front portion 319. The rear portion 318 is located in the counterbore 308 in the valve body 234 and mounted on the valve body 234 by a swivel pin 322. Swivel pin 322 permits the adaptor 312 to pivot about a vertical axis 324 relative to the valve body 234. The throttle grip 314 is mounted on the front portion 319. A gap, formed between the rear end of the counterbore 308 in the valve body 234 and the rear end of the adaptor 312, defines the pivot limit of the tiller actuator portion 236 as it pivots about the pin 322. The front end 274 throttle shaft 272 extends into the bore 316 of the grip adaptor 312, where it is joined to a throttle shaft extension 326 via a swivel joint 328 that permits the shaft extension 326 to swivel relative to the remainder of the throttle shaft 272. An L-shaped actuator arm 330 extends downwardly from the rear end 318 of adaptor 312 and is coupled to the front end of the cam assembly 282 by a yoke 332. Hence, pivoting motion of the tiller actuator portion 236 results in linear movement of the cam assembly 282.

Figure 11:
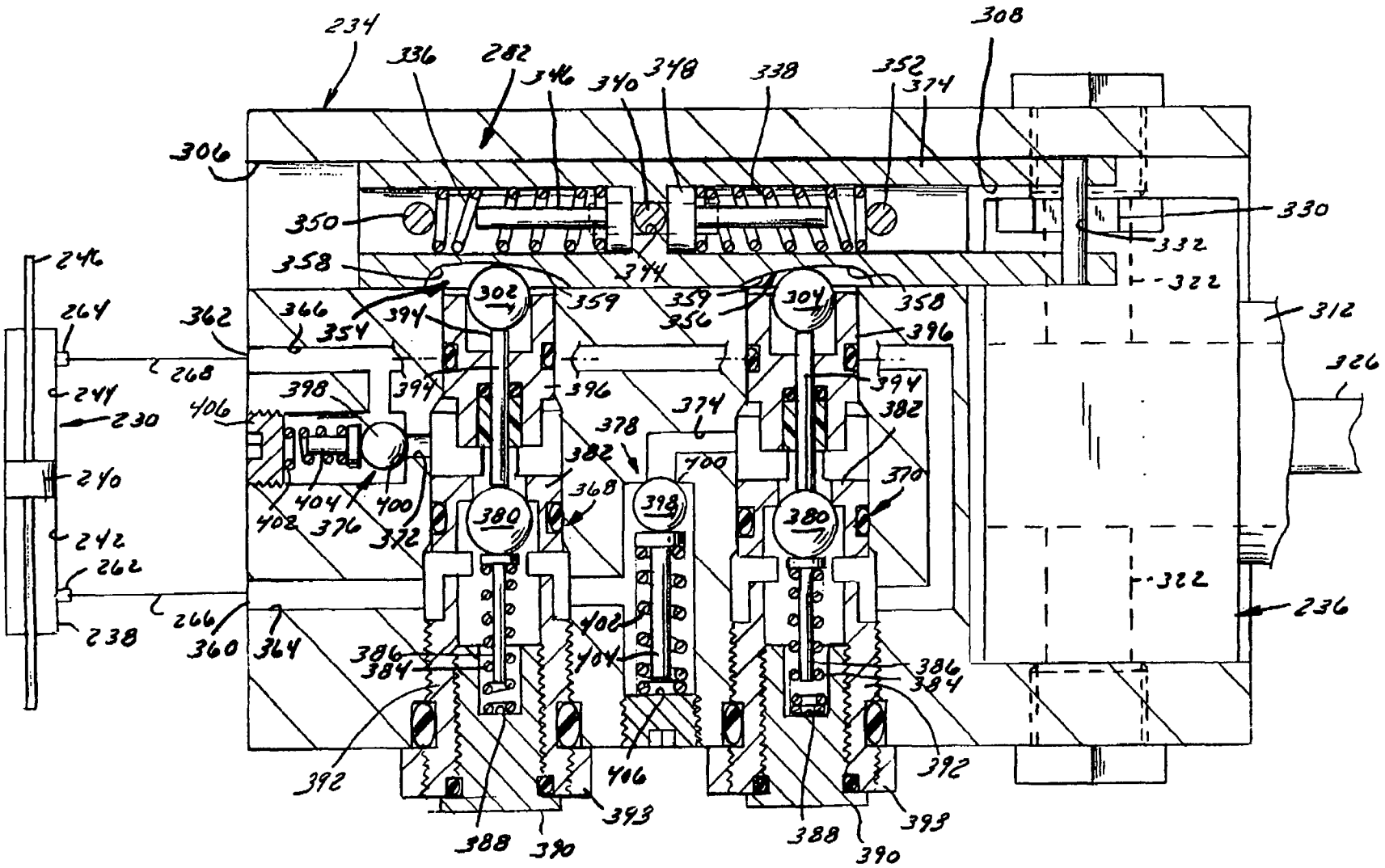
FIG. 11 is a sectional plan view of the portion of the tiller of FIG. 8.

Referring now to FIGS. 10 and 11, the cam assembly 282 includes the cam body 334 that is reciprocatably slidable within the bore 306 to selectively actuate first and second cam followers 302 and 304, each of which actuates a respective control valve of the valve assembly 232. The cam followers 302 and 304 of the illustrated embodiment take the form of cam balls. The front end of the cam body 334 is connected to the actuator arm 330 via the yoke 332. The cam body 334 is hollow so as to receive first and second centering springs 336 and 338. The centering springs 336 and 338 are symmetrical about a stationary centering pin 340 extends laterally through the cam body 334 and is retained in a lateral bore 342 that intersects the bore 306 in the valve body 234. The centering pin 340 extends through an elongated slot 344 in the cam body 334 so as to permit the cam body 334 to move longitudinally within the bore 306. The centering springs 336 and 338 are seated against opposite sides of the centering pin 344 via first and second spring guides 346 and 348. The opposite end of each centering spring 336, 338 rests on a retaining pin 350, 352 extending transversely through the cam body 334. Each spring 336, 338 is sufficiently strong to not only bias the cam body 334 to the center position illustrated in FIG. 10, but also to bias the tiller actuator portion 236 to the neutral position illustrated in FIG. 10. The springs 336 and 338 preferably each have a spring constant of 10-15 lbs.

As best seen in FIG. 11, cam grooves 354 and 356 are formed in the lower surface of the cam body 334 in alignment with cam followers 302 and 304. The cam grooves 352 and 354 are symmetrical about the lateral centerline of the cam body 334, each having a relatively deep portion 358 located relatively far apart from the centering pin 340 and a relatively shallow portion 359 located relatively close to the centering pin 340. The cam grooves 354 and 356 and cam followers 302 or 304 are located and dimensioned relative to one another such that one of the cam followers 302 and 304 rides along the surface of the associated cam groove 354 and 356 into an actuated position as the cam body 334 moves in one direction relative to the centering pin 340, whereas the opposite cam follower 304 and 302 remains stationary or at least is not driven downwardly far enough to actuate the associated control valve. Both cam followers 302 and 304 remain in a deactuated position when the cam body 334 assumes its centered, neutral position. The extent of cam follower stroke for a given cam body stroke is dependent upon the profile of the associated cam groove 354 or 356, hence permitting a progressive, nonlinear cam follower stroke. Moreover, because the operative portion of the cam body 334 could be located anywhere along the length of the tiller arm 370, the cam followers 302 and 304 and associated control valves could be located virtually anywhere along the length of the tiller 226, permitting versatility of valve body positioning.

Figure 12:
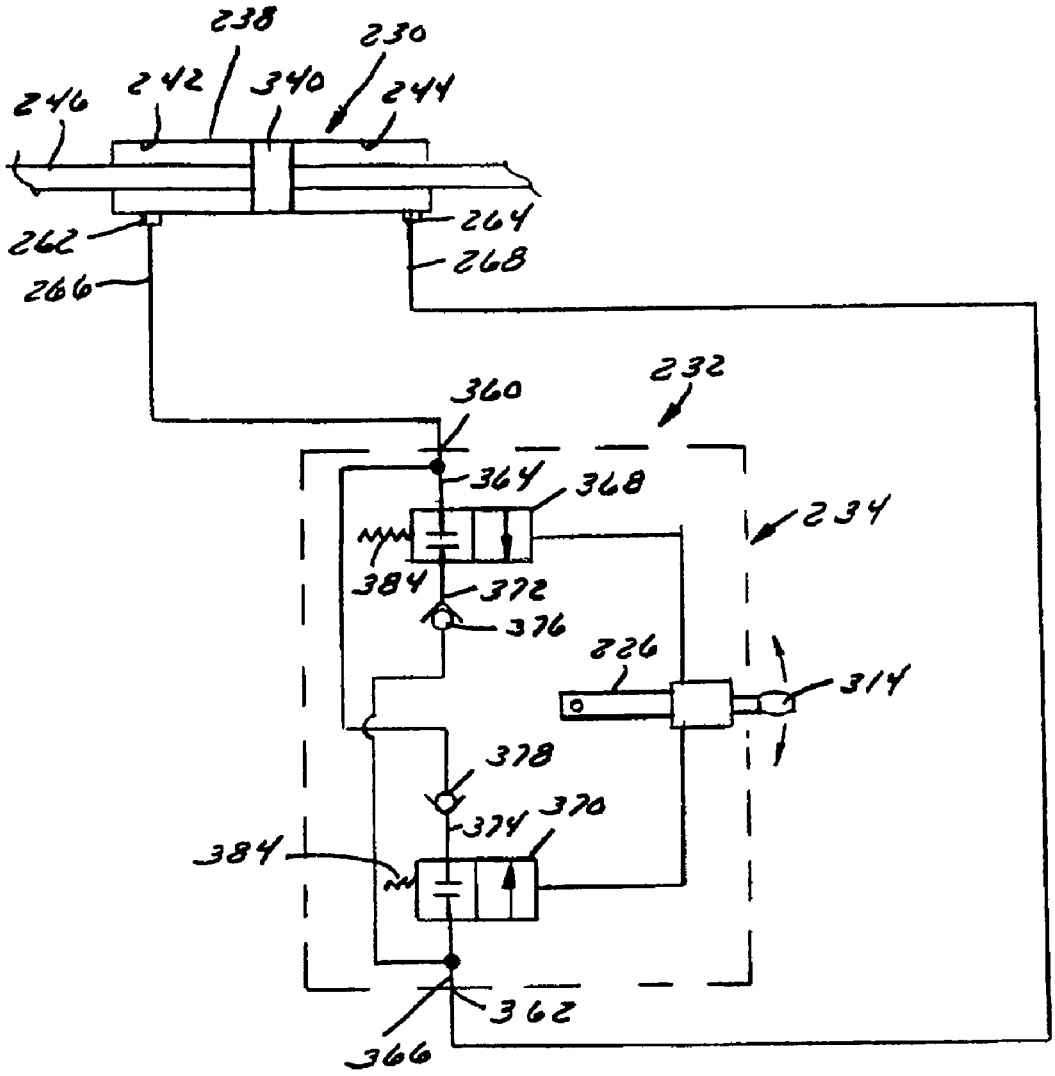
FIG. 12 is a hydraulic circuit schematic illustrating the construction and operation of the hydraulic components of the steering system of FIGS. 8-11.

Referring to FIGS. 11 and 12, the valve assembly 232 of this embodiment, like the corresponding assembly of the first embodiment, has first and second ports 360, 362 that communicate with the corresponding first ands second chambers 242, 244 in the cylinder 238 via the associated hydraulic lines 266, 268. The valve assembly 232 of this embodiment, though somewhat more complicated than the corresponding valve assembly of the first embodiment, performs the same function. That is, when the tiller actuator portion 236 is in its neutral position, the valve assembly 232 remains deactuated to prevent fluid flow through the valve body 234 and lock the steering cylinder piston 240 in its then-existing position, hence retaining the last commanded steering angle. It is also actuated when the tiller actuator portion 236 pivots in either direction about its pivot axis, thereby permitting fluid flow therethrough and permitting steering.

Still referring to FIGS. 11 and 12, the valve assembly 332 of this embodiment includes first and second inlet/outlet passages 364 and 366 opening into the first and second ports 360 and 362, respectively. Each passage 364 and 366 is also connected to respective cam operated control valve 368, 370. The opposite side of each control valve 368, 370 is connected to the opposite passage 366, 364 by a bypass passage 372, 374 that bypasses the other control valve 370, 368 and that contains a check valve 376, 378.

The first and second control valves 368 and 370 are essentially identical to the corresponding check control valves of the first embodiment. Hence, each valve 368, 370 includes a ball 380 located adjacent a seat 382. Each ball 380 is biased against its seat 382 by a return spring 384 seating against a spring guide 386 at one end and against a spring seat 388 at its opposite end. Each return spring 384 is of intermediate strength (e.g., 3-4 lbs.) to provide a secondary seal should the relatively low pressure check valves 376, 378 leak. Each spring seat 388 is formed by a step in a bore in a plug 390 threadedly mounted in a sleeve 392 screwed into the bottom of the valve body 234. The valve 368 or 370 can be moved in or out to adjust the distance between the ball 302 and 304 or the cam 354 or 356. A nut 393 locks the valve 368 or 370 in place.

During control valve actuation, the ball 380 of the actuated valve 368 or 370 is pushed downwardly away from the seat 382 by an actuator pin 394. The actuator pin 394 of each control valve 368 or 370 extends upwardly from the associated ball 380, through a pin guide 396, and into contact with an associated cam follower 302 or 304. Hence, when a cam follower 302 or 304 is driven downwardly by the associated cam groove 354 or 356, the actuator pin 394 of the associated control valve 368 or 370 drives the ball 380 from its seat 382 against the force of the return spring 384 to open the control valve and permit fluid flow into the associated bypass passage 372 or 374.

The check valves 376 and 378 permit the fluid circuit in the valve assembly 232 to be completed in either direction of fluid flow while preventing any backflow when the associated control valve 368 or 370 open. Each of the check valves 376, 378 comprises a ball 398 that is biased against a seat 400 in the corresponding bypass passage 372 or 374 by a relatively weak return spring 402 having spring constant of, e.g., ¼ to ½ lb. Each return spring 402 is guided by a spring guide 404 and seats on plug 406 threaded into the valve body 234 to seal the end of the associated bypass passage 372 or 374.

As a result of this arrangement, fluid flow through the valve assembly 232 is blocked when the cam body 334 and tiller actuator portion 236 are in their neutral position, and fluid is free to flow between the ports 360 and 362 whenever the tiller actuator portion 236 is pivoted to one side or the other from its neutral position to drive one of the associated cam followers 302, 304 downwardly to the open the associated control valve 368 or 370.

In use, whenever the operator does not apply steering forces to the throttle grip 314, the tiller actuator portion 236 and cam assembly 282 retain their neutral positions illustrated in FIGS. 10 and 11 in which the cam body 334 is centered relative to the centering pin 340. Both cam followers 302, 304 contact a relatively deep portion of the corresponding cam groove at this time and to permit the balls 380 of the control valves 368, 370 to remain seated, hence preventing fluid flow through either of the control valves 368, 370. Chambers 242 and 244 of cylinder 238 therefore remain isolated from one another, and the piston 240 and rod 246 are locked from movement, thereby preventing reaction forces imposed on or by the motor 20 from changing the steering angle of the boat 10.

Figure 13:
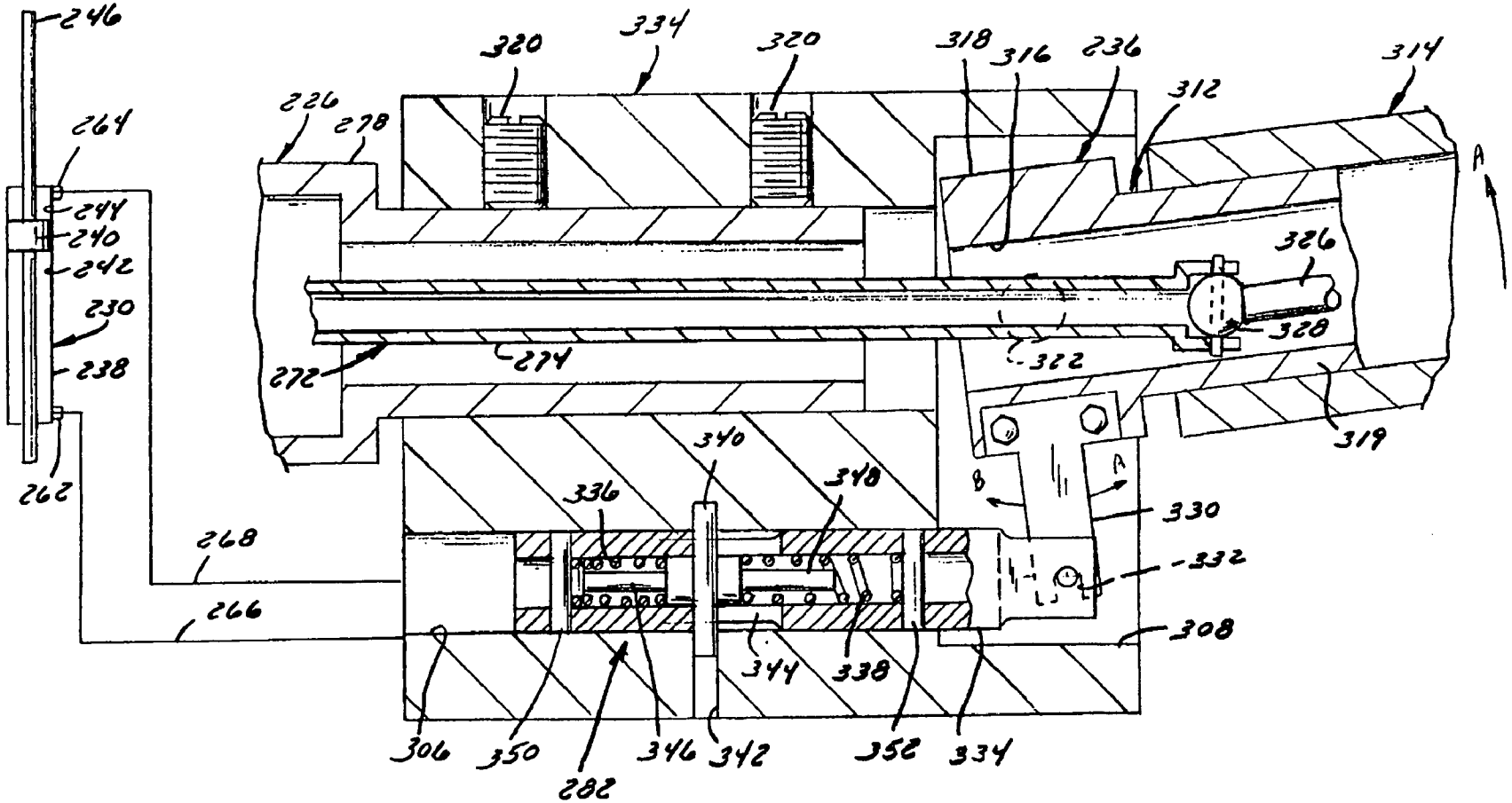
FIG. 13 corresponds to FIG. 10 but illustrates the steering system in an actuated position thereof.
Figure 14:
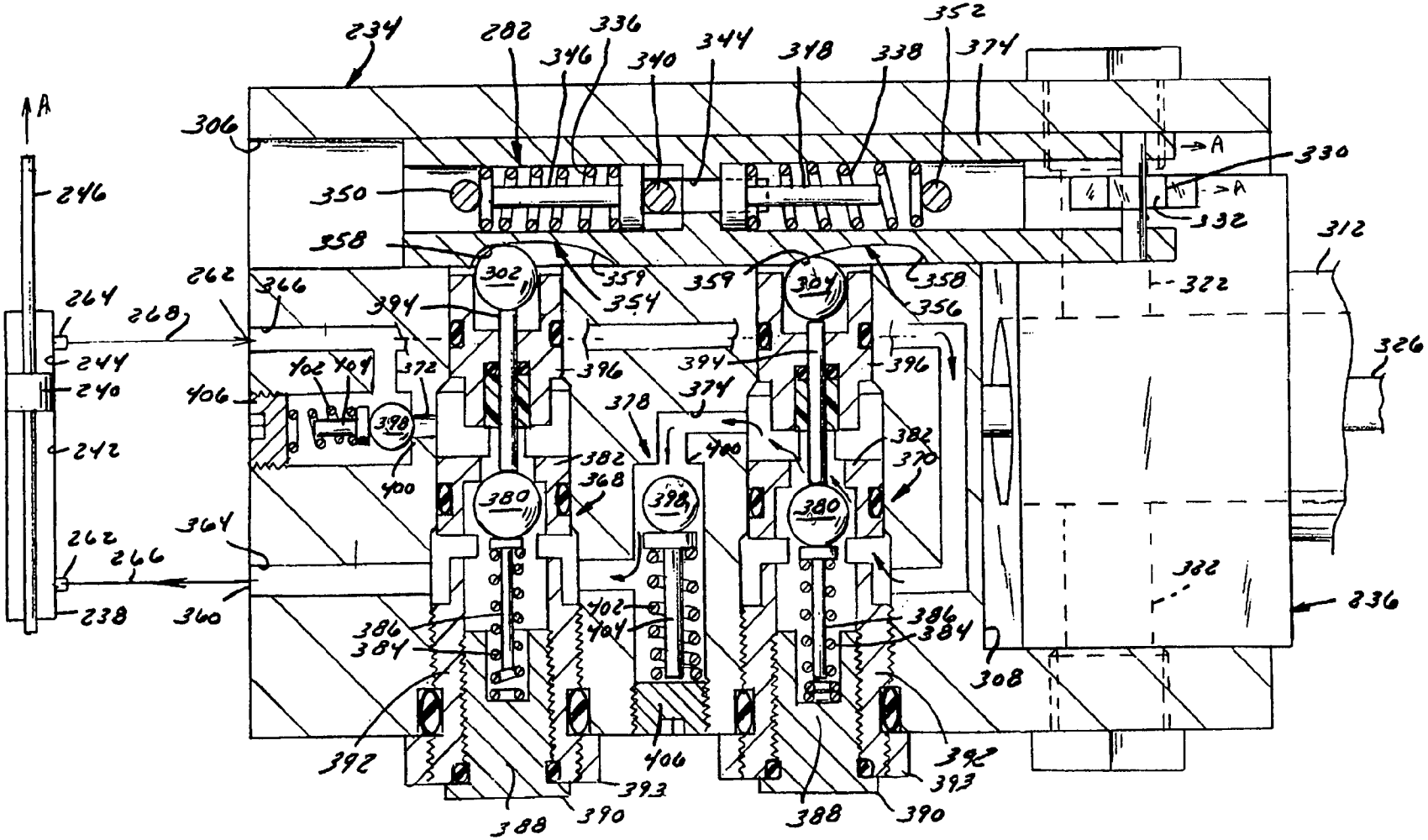
FIG. 14 corresponds to FIG. 11 but illustrates the steering system in an actuated position thereof.

Referring now to FIGS. 13 and 14, when the tiller actuator portion 236 is pivoted in a counterclockwise by pushing on the throttle grip 314, the cam body 334 moves to the right as viewed in the drawings so that the cam groove 356 forces the cam follower 304 downward to open control valve 370. Additional manual tiller actuation will move the engine 20 and cylinder piston 344 to direction A. Fluid in the chamber 244 of the cylinder 238 is then forced out of the port 264, through the line 268, past the control valve 370, into the bypass passage 374, past the low pressure check valve 378, into line 266, and into the chamber 242 of the cylinder 238 through the port 262. If the operator wishes to steer the boat in the opposite direction, he or she pivots the throttle grip 314 in the opposite direction, hence driving the cam body 334 in the opposite direction, opening the control valve 368, and permitting fluid to flow from the chamber 242, through the control valve 368, the bypass passage 372, out of the port 362, and into the opposite chamber 244 via port 264. Here again, the operator does not have to release the grip. If the engine does not have an input to the system, the movement will stop when the operator input is stopped. If the engine has a torque input, this input will move the tiller arm to close the valves. In either case, if the operator releases the throttle grip 314, the relatively strong springs 336 and 338 will return the cam body 334 to its neutral position, closing all valves, recentering the tiller actuation portion 236, and locking the piston 240 from further motion to retain the last commanded steering angle.

Figure 15:
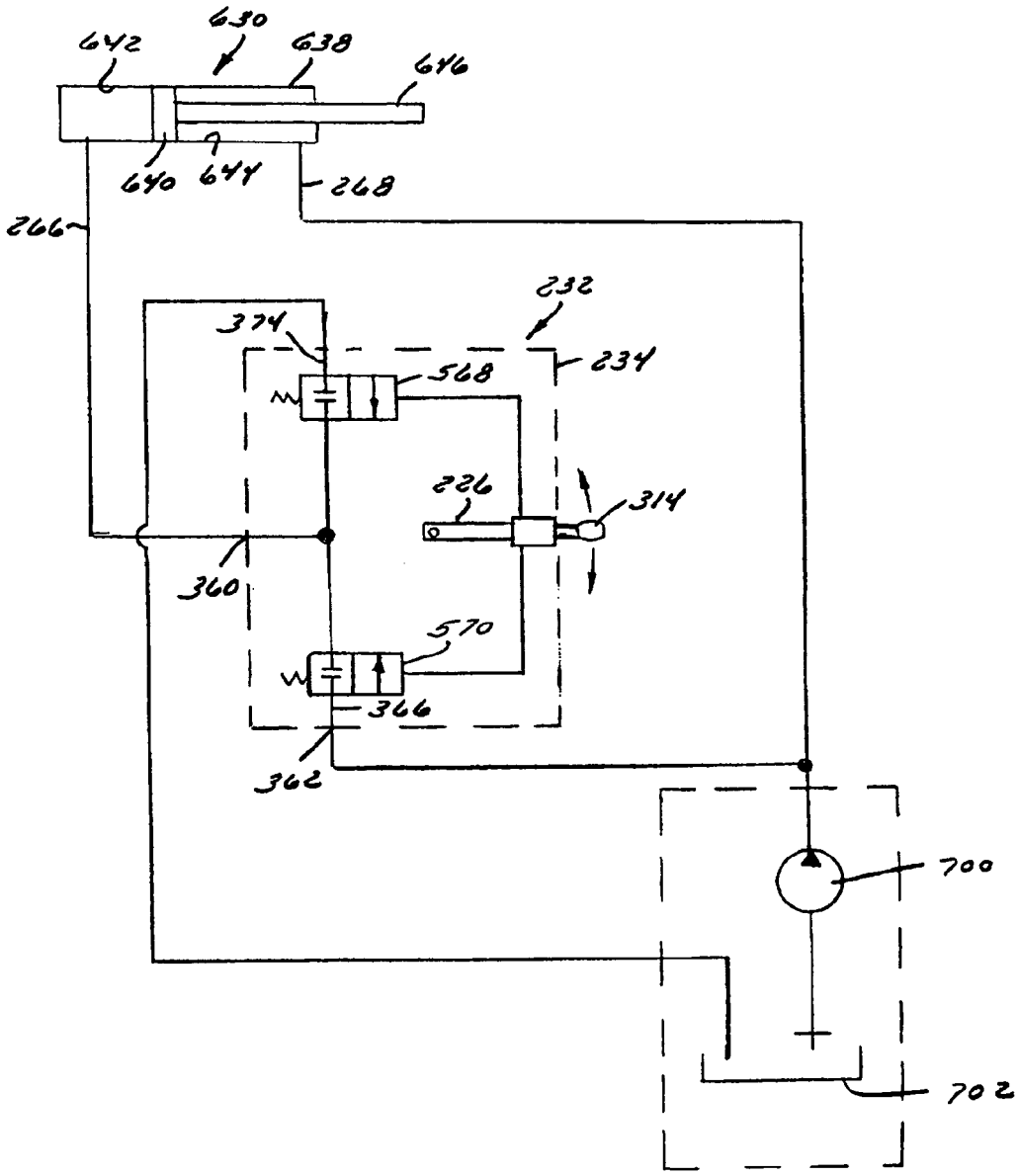
FIG. 15 is hydraulic circuit schematic illustrating the construction and operation of the hydraulic components of the steering system of FIGS. 8-11.

In addition to being easily incorporated into an existing tiller design or even mounted onto an existing tiller handle in a retrofit fashion, the steering assembly 210 of this embodiment provides the additional advantage of being easily reconfigured as a power assist steering system. Referring to FIG. 11, all that needs to be done is for the operator to open both plugs 406 in the valve body 234 and remove the check valves 376 and 378. Then, referring to FIG. 15, the line 268 that previously was connected to only the chamber 242 in the cylinder 238 will now be connected to the corresponding chamber 642 of an unbalanced cylinder 638 and to a power supply such as the outlet of a pump 700. Passage 374, which previously contained the check valve 378, would also be connected to a reservoir 702 at this time. The resulting power assist steering system would operate in the same manner as that disclosed in U.S. Pat. No. 6,715,438, issued Apr. 6, 2004, the subject matter of which is incorporated by reference.

4. Construction and Operation of Third Embodiment

Turning now to FIGS. 16-22B, a self-locking tiller actuated steering system 410 constructed in accordance with a third preferred embodiment of the invention is illustrated.

The steering system 410 differs from those of the prior embodiments in that it is considerably simpler and less expensive to manufacture and assemble. It is also potentially more reliable. The most notable difference from a functional standpoint is that the control valves are actuated remotely by cables 490 and 492 rather than directly by the actuator on the tiller, hence permitting the valve assembly to be mounted on the cylinder assembly and providing a much simpler tiller extension.

Figure 16:
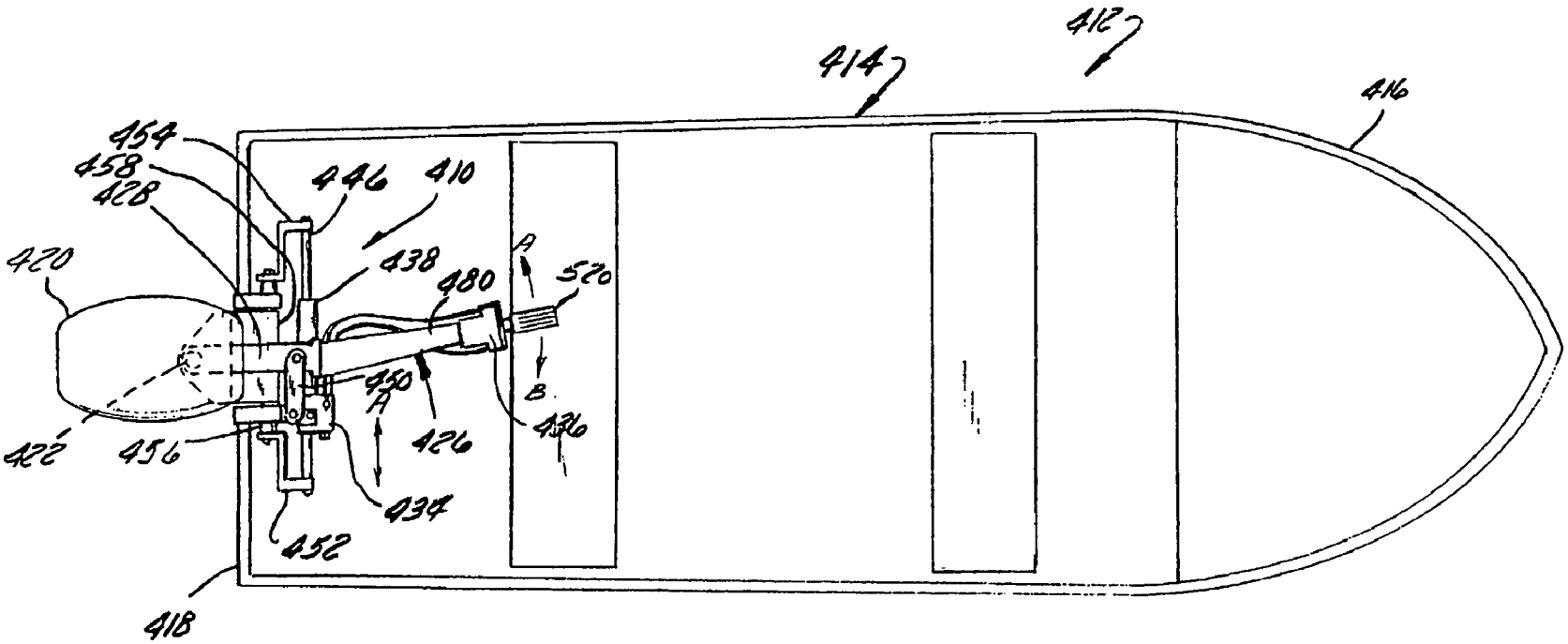
FIG. 16 is a schematic top plan view of a boat incorporating a self-locking tiller-operated steering system constructed in accordance with another preferred embodiment of the present invention.
Figure 18:
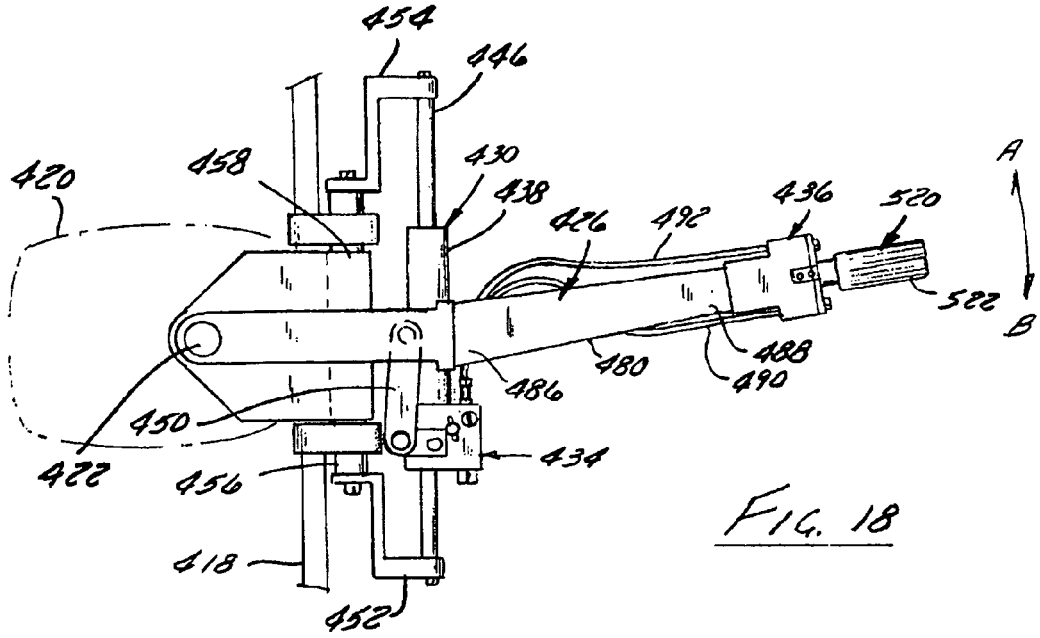
FIG. 18 is top plan view of the steering system of FIG. 17.
Figure 17:
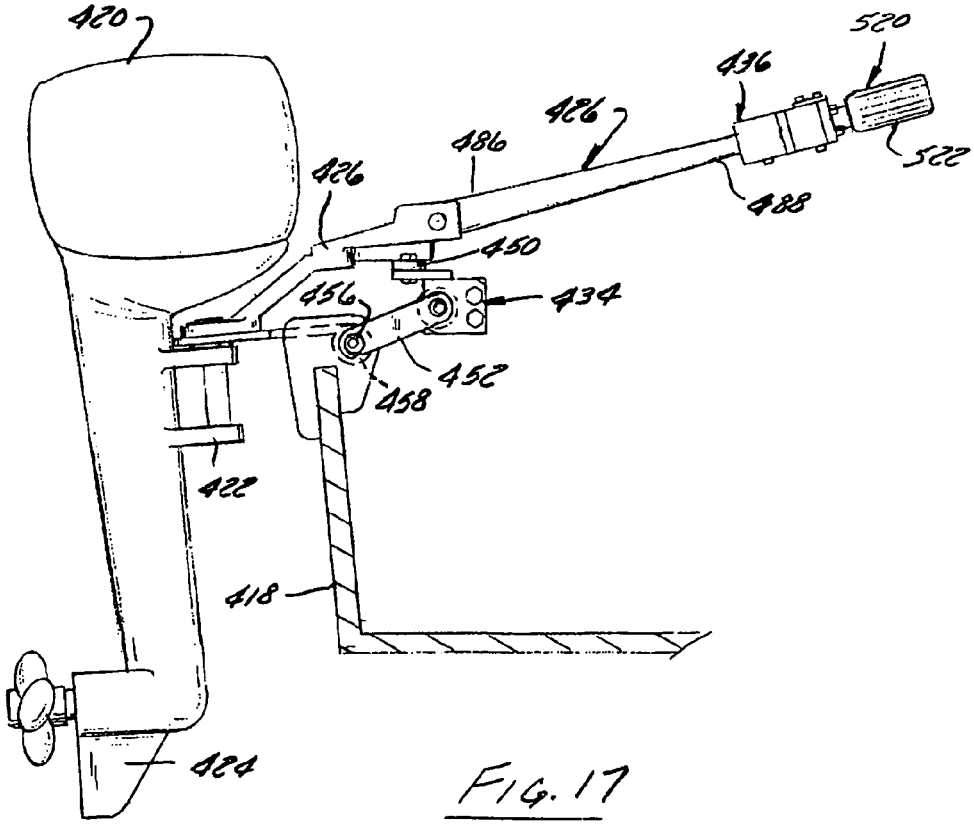
FIG. 17 is a side elevation view of the stem of the boat, showing the engine and steering system mounted on the stem.

Referring initially to FIGS. 16-18, the steering system 410 of this embodiment includes a tiller 426, a hydraulic lock in the form of a hydraulic cylinder assembly 430, and a valve assembly 432 that is housed in a valve unit 434 mounted on or even formed integrally with the cylinder assembly 430 to produce a module 435. The valve assembly 432 acts as an "engager" that is responsive to tiller operation to selectively engage and disengage the hydraulic lock by selectively permitting or preventing a movable portion of the cylinder assembly 430 from moving. More specifically, the valve assembly 432 is actuated in response to movement of an actuator portion 436 of the tiller 426 relative to another portion of tiller 426 from a neutral position thereof in order to permit fluid to flow within and to and from the cylinder assembly 430 to disengage the lock and permit movement of the portion of the tiller 426 that is coupled to the system's steering arm 428. The valve assembly 432 is deactuated when the input to the actuator portion 436 is stopped and the actuator portion 436 returns to its neutral position to prevent fluid from flowing to or from the cylinder assembly 430, hence engaging the hydraulic lock and preventing tiller movement. This prevents reaction forces imposed on or by the engine 420 from being transmitted to the tiller 426 and maintains the last commanded steering angle of the rudder 424. The hydraulic cylinder assembly 430, tiller 426, and valve assembly 432 will now be described in turn.

Figure 19:
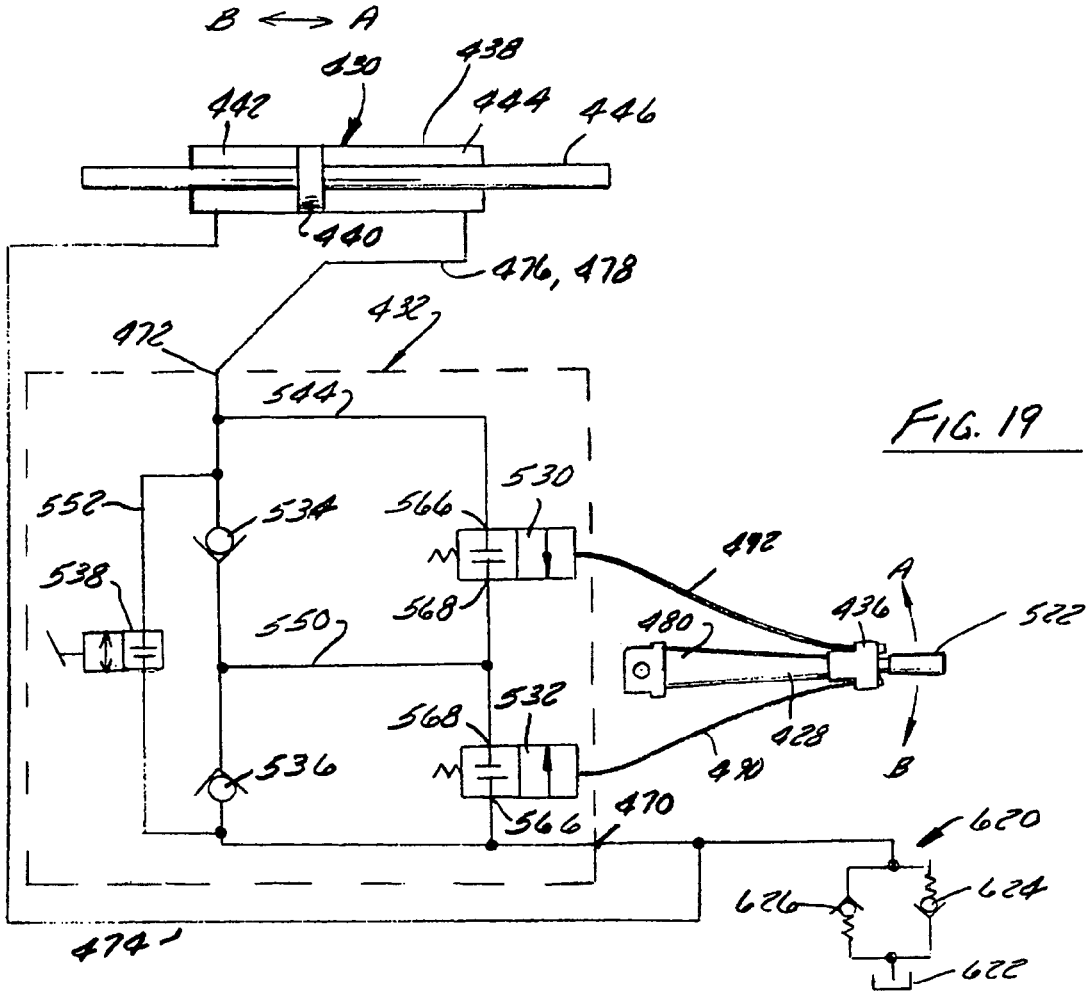
FIG. 19 is a circuit schematic illustrating the construction and operation of the operative components of the steering system of FIGS. 16-18.
Figure 20:
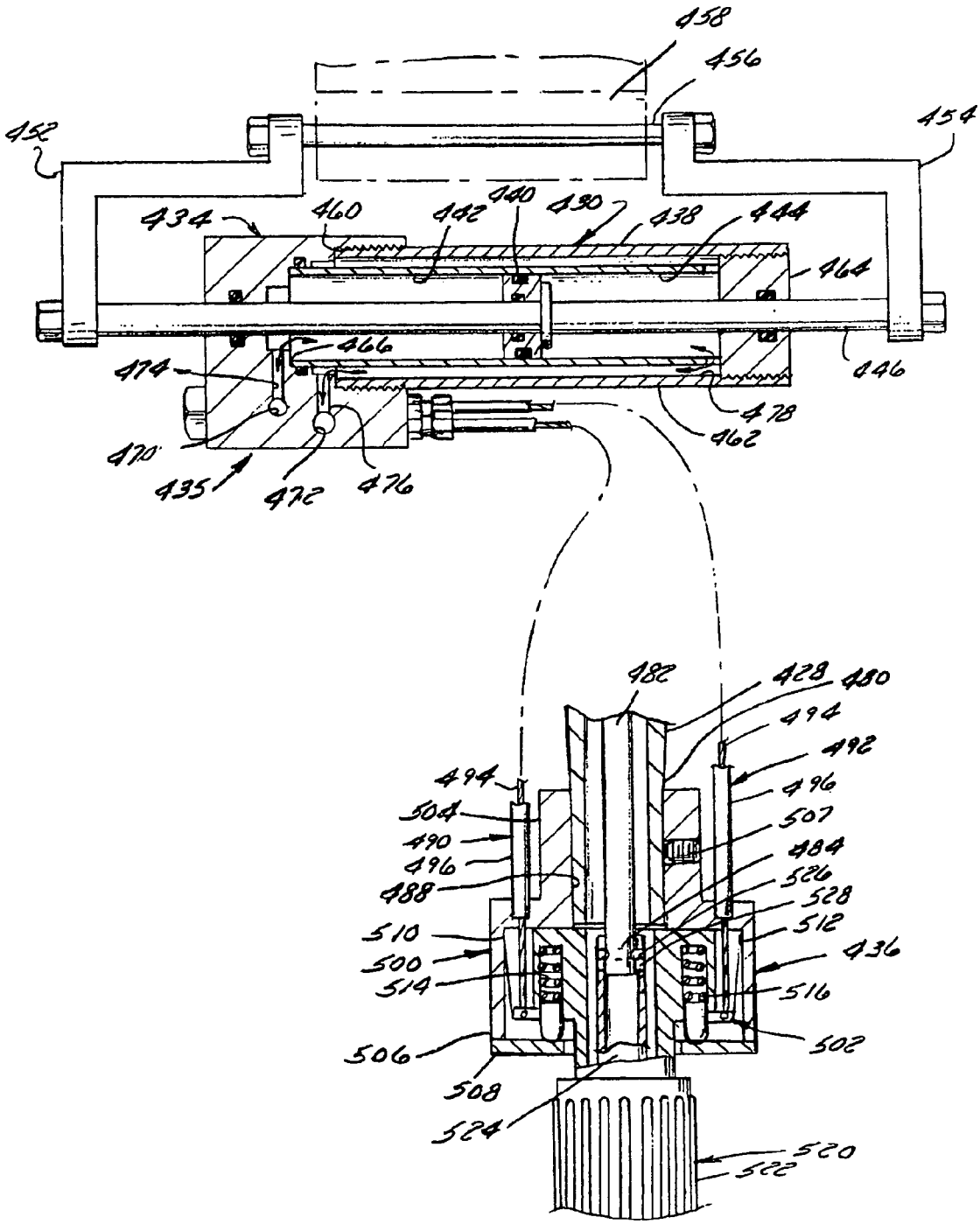
FIG. 20 is a sectional elevation view of a portion of the steering system of FIGS. 2-4 that includes an actuator and cylinder of the steering system.

Referring now to the mechanical drawings of FIGS. 17-18 and 20 and to the hydraulic schematic of FIG. 19, the hydraulic cylinder assembly 430 includes a cylinder 438, a balanced piston 440 that is mounted in the cylinder 438 to define first and second chambers 442 and 444 on opposite sides thereof, and a rod 446 that is affixed to the piston 440 and that extends through both ends of the cylinder 438. Pursuant to this embodiment of the invention, one of the rod 446 and the cylinder 438 is movable relative to the other and is connected to the steering arm 428, and the other of the rod 446 of the cylinder 438 is mounted on a fixed support such as the transom 418 or on an intervening mounting assembly.

Referring to FIGS. 16-18, the cylinder 438 of this embodiment is coupled to the steering arm 428, and the rod 446 is mounted on the transom 418. Specifically, the cylinder 438 is coupled to the steering arm 428 by a link 450 so that the cylinder 438 moves back and forth with pivoting movement of steering arm 428. The rod 446 extends through opposite ends of the cylinder 438, where each end is supported on a first end of a respective mounting bracket 452, 454. The opposite end of each mounting bracket 452, 454 is connected to a respective end of a rod 456 that extends through a tilt tube 458 of the engine 420 as best seen in FIG. 20. The rod 456 locks the brackets 452, 454 and the rod 446 to the engine mount so that they cannot move side to side relative to the engine mount or the transom 418.

As indicated above, the valve assembly 432 can be located remote from the tiller actuator portion 436. For instance, the valve unit 434 that houses the valve assembly 432 may be mounted on or even form part of the cylinder 438, hence forming a combined module 435. That is the case in the illustrated embodiment. As best seen in FIG. 20, the valve unit 434 has a stepped internal bore 460 that is located beside the valve assembly 432 and that is internally threaded at one end. The majority of the cylinder 438 is formed from a cylinder body 462 that is closed at one end by a cap 464 and that is open at the other end 466. The threaded bore 460 in the valve unit 434 is screwed over the end 466 of the cylinder body 462 to form the end of the chamber 442.

The chambers 442 and 444 are fluidically coupled to respective ports 470 and 472 in the valve assembly 432 (FIGS. 22A and 22B) by internal passages in the module 435 (FIG. 20), hence negating the need for hydraulic hoses. This, in turn, further reduces manufacturing costs and system complexity, and increases reliability by eliminating hoses and fittings that might rupture or leak. Specifically referring to FIGS. 20 and 22A the port 470 in the valve assembly 432 opens into a passage 474 that extends perpendicularly to the end of the chamber 442. The port 472 opens into a passage 476 that extend perpendicular to another passage 478. The passage 478 extends axially along the cylinder body 462 in parallel with the chambers 442 and 444 and opens into the end of the chamber 444.

Tiller pivoting motion causes the steering arm 428 to swing in the direction of the arrow in FIG. 16, resulting in a corresponding axial movement of the cylinder 438 along the rod 446 in the same direction. This movement drives the cylinder 438 to move relative to the piston 440, forcing hydraulic fluid out of one of the chambers 442 or 444, through the open valve assembly 432, and into the other chamber 444 or 442. When the hydraulic lock is engaged to block fluid flow to and from the cylinder 438, the cylinder 438 cannot move relative to the piston 440 and rod 446, hence locking the cylinder 438 in place and thereby locking the steering arm 428 and the tiller 426 in place. The last commanded steering angle of the rudder 424 is thus maintained.

Referring to FIGS. 17, 18, 20, and 21, the front end of the tiller 426 includes a hollow arm 480 and a throttle shaft 482. The throttle shaft 482 extends through the hollow interior of the arm 480. It has a proximal, rear end (not shown) borne in the hub of a throttle cable drive pulley (not shown). It also has a distal front end 484 that is attached to the tiller actuator portion 436 as described below. The tiller arm 480 extends from a rear, proximal end 486 affixed to the steering arm 428 to a front end 488. The front end 488 supports the tiller actuator portion 436.

The actuator portion 436 of the tiller 426 comprises an articulating front end portion of the tiller 426 that is mounted on the front end of the tiller arm 480 so that a portion thereof is pivotable through a limited stroke relative to the tiller arm 480. In this embodiment, the pivoting motion of the actuator portion 436 from a neutral position extends or retracts cables 490, 492 to actuate the valve assembly. As is conventional, each cable 490, 492 includes an inner core 494 covered by an outer sleeve 496 as seen in FIG. 20.

Figure 21:
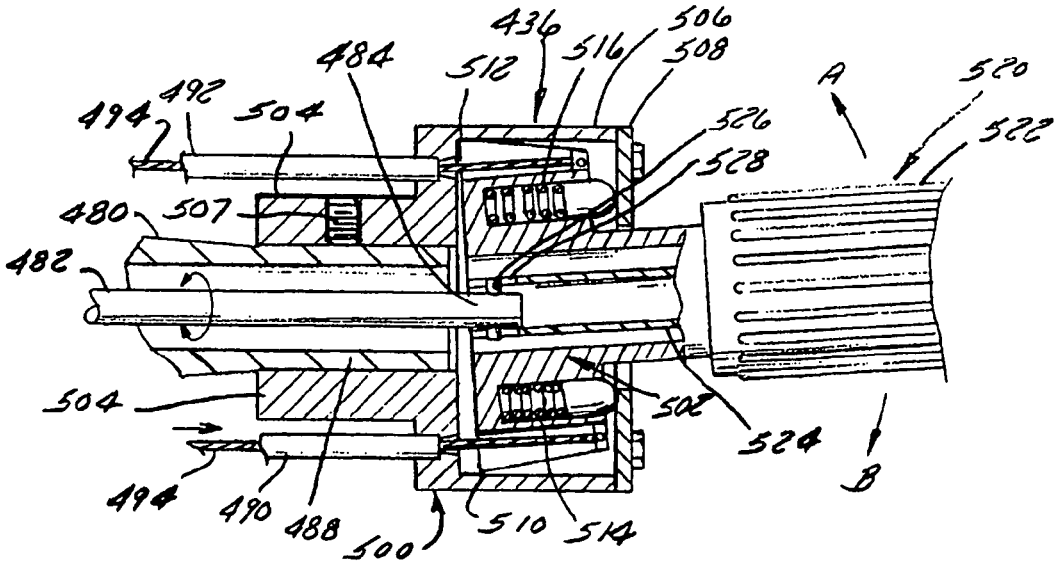
FIG. 21 is a sectional elevation view showing the actuator in an actuated position thereof.

Referring now to FIGS. 20 and 21, the tiller actuator portion 436 includes an actuator housing 500 and an actuator block 502 that is pivotally mounted in the actuator housing 500. The actuator housing 500 has a reduced diameter rear end 504 that surrounds the front end 488 of the tiller arm 480 and an enlarged diameter front end 506 that extends beyond the front end 488 of the tiller arm 480. The actuator housing 500 is mounted on the front end 488 of the tiller arm 480 by a set screw 507. A cover plate 508 is mounted on the front end 506 of the actuator housing 500. The actuator block 502 comprises a metal block supported in the actuator housing 500 so as to rock about points 510, 512 located at the outer lateral edges of the actuator block 502. The ability to rock about points 510, 512 as opposed to pivoting about the center of the actuator block 502 provides a greater range of motion before the front end of the block 502 abuts against the cover plate 508. Pivoting the handle at points 512 and 510 provides maximum movement of the cables 490 and 492 for a given throttle grip stroke and a given actuator block width. If the handle would pivot along its center like the system in the second embodiment, the grip 522 would have to be moved twice as far to obtain the same cable extension. The actuator block 502 is biased to its central or neutral position by first and second return springs 514, 516 that acts against the cover plate 508. One end of the movable inner core 494 of each cable 490, 492 is affixed to the actuator block 502 outboard of the return springs 514, 516. The opposite end of each inner core is connected to the valve actuator rod for the associated control valve as detailed below.

Referring to FIGS. 20 and 21, the actuator portion 436 of tiller 426 further includes a throttle grip assembly 520. The throttle grip assembly 520 comprises a throttle grip 522 mounted on an extension of the actuator block 502 extending forwardly through an aperture in the cover plate 508. A throttle shaft mounting tube 524 extends rearwardly through an enlarged bore in the actuator block 502 and is mounted over the front end of the throttle shaft 482. The throttle shaft mounting tube 524 is coupled to the throttle shaft 482 by a pin 526 that extends radially through the throttle shaft and through opposed slots 528 in the mounting tube 524, thereby permitting the mounting tube 524 and the actuator block 502 to rock relative to the throttle shaft 482 while causing the throttle shaft 482 to rotate when the throttle grip 522 is twisted.

Figure 22H:
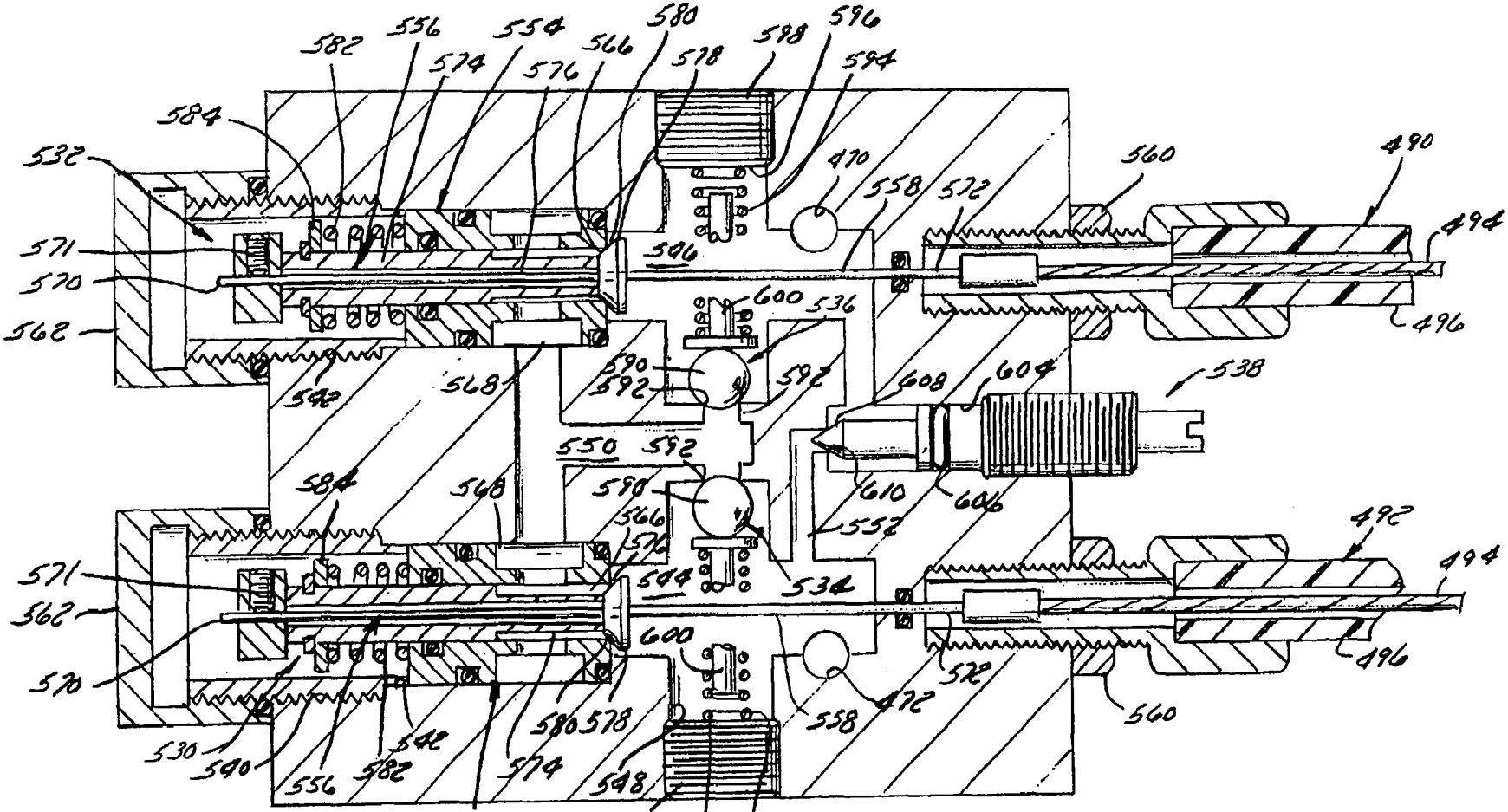
FIG. 22A is a sectional plan view of the valve assembly of the steering system of FIGS. 16-18 in a closed or system locked position thereof.
FIG. 22B corresponds to FIG. 22A and shows the valve actuator in an open or system unlocked position thereof.

Referring now to FIGS. 19 and 22A, the valve assembly 432 comprises first and second cable operated control valves 530, 532, first and second normally closed pressure operated check valves 534, 536, and a manual bypass valve 538, all located in the valve unit 434. First and second longitudinal through bores 540, 542 are formed in the valve unit 434 to house the control valves 530 and 532 and their cable actuators. Intermediate sections of the bores 540, 542 form chambers 544, 546 connecting the ports 472, 470 to the valves 530, 534 and 532, 536. A lateral through bore 548 in the valve unit 434 contains the check valves 534, 536. Also formed in the valve unit 434 are 1) a T-shaped internal passage 550 connecting the outlets of the control valves 530 and 532 to the lateral through bore 548 and the inlets of the spring biased check valves 534, 536 and 2) a bypass passage 552 containing the manual bypass valve 538.

The first and second control valves 530, 532 and their actuators are identical in construction. The control valve 532 will now be described, it being understood that the description applies equally to the control valve 530. Control valve 532 includes a stationary valve body 554, a movable valve element 556, and a movable actuating rod 558. The actuating rod 558 is driven by the aforementioned cable 490, the end of the inner core 494 of which is located in a fitting 560 threaded into the proximal end of the bore 542. The valve body 554 is captured in the bore 540 by a threaded cap 562 that also seals the distal end of the bore 540. The valve body 554 has an axial through bore 564, the proximal end of which is enlarged to present a chamber having an axial inlet port 566 and a radial outlet port 568.

The actuating rod 558 extends longitudinally from a distal end 570 located behind the valve body 554, through the valve body 554, and the chamber 544, and to a proximal end 572 located in front of the chamber 544, where it is connected to the end of the inner core 494 of the associated cable 490. The valve element 556 is mounted on the distal end 570 of the actuating rod 558 by a set screw 571. Valve element 556 comprises a cylinder 574 that is slidably guided by the valve body 554 and that has a through bore 576 receiving the actuating rod 558. A conical check 578 is formed on the proximal end of the valve element 556 and is sealingly mounted on the actuating rod 558 so as to move therewith. The check 578 is biased against a seat 580 on the valve body 554 by a spring 582. The spring 582 is seated against the valve body 554 at its proximal end and against a fixed keeper 584 on the cylinder 574 at its distal end.

Figure 22B:
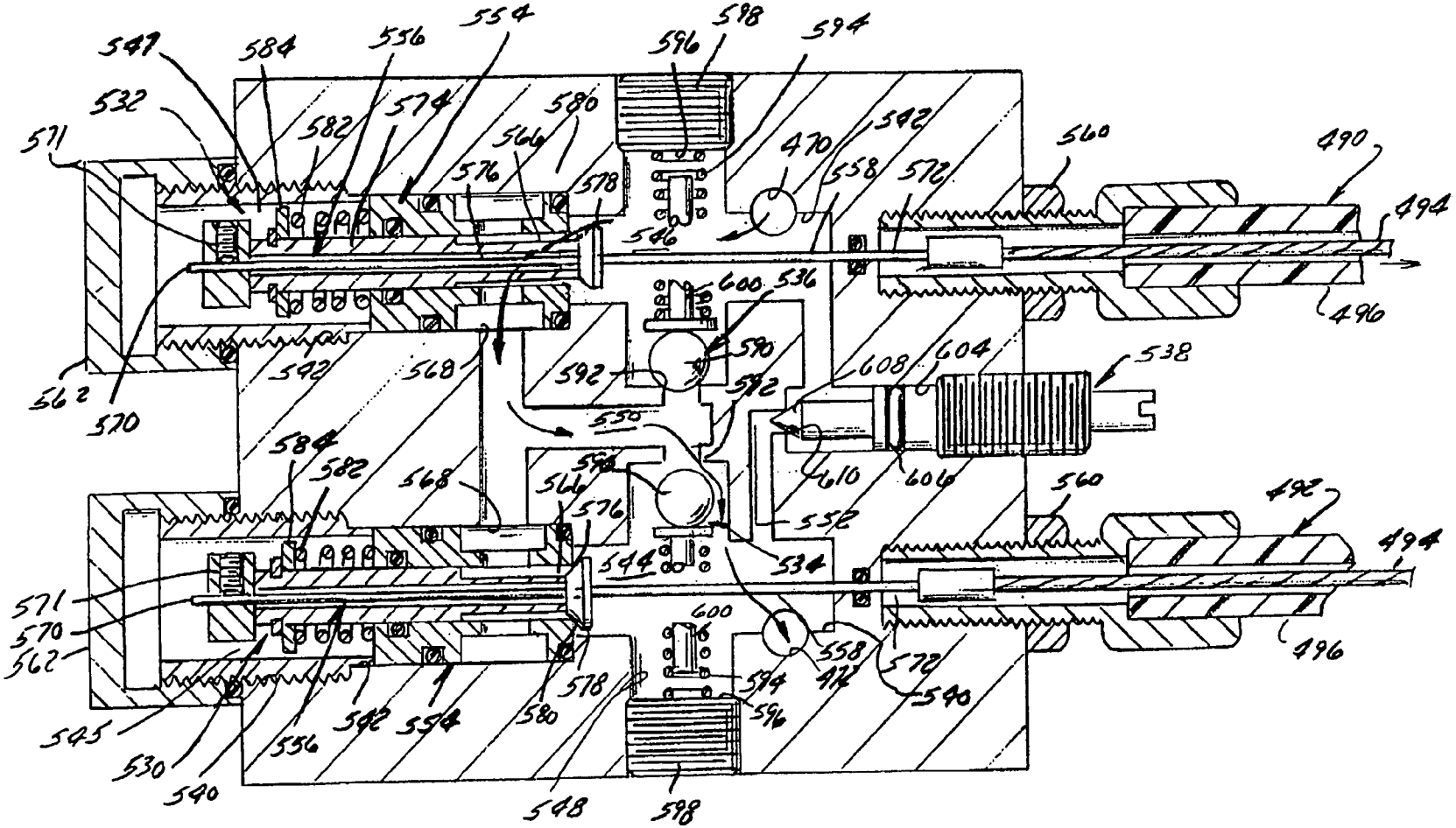

The control valves 530 and 532 each normally assumes the position illustrated in FIG. 22A in which the check 578 seats against the seat 580 to seal the ports 566 and 568 of the relevant control valve 530 or 532 from one another in the absence of a tiller actuation. When the operator pivots the tiller 426 in a manner to pull the cable inner core 494 proximally away from the valve unit 434, the appropriate actuating rod 558 is pulled to the right as seen in FIG. 22B to connect the inlet port 566 to the outlet port 568.

The check valves 534 and 536 are also identical to one another in construction. The valve 534 will now be described, it being understood that the description applies equally to the valve 536. The valve 534 includes a check ball 590 located adjacent a seat 592 in bore 548. The check ball 590 is biased against the seat 592 by a relatively weak return spring 594 that seats against the check ball 590 at one end and against a spring seat 596 at its rear end. The spring seat 596 is formed from a cap 598 that is threaded into the bore 548 to seal the bore. The spring 594 is also guided by a guide rod 600 extending from the check ball 590 toward the seat 596.

The bypass valve 538 comprises a threaded rod screwed into an externally threaded bore 604 in the valve unit 434. The rod is sealed in the bore 604 by an O-ring 606. It includes a conical tip 608 acting as a poppit that that engages a seat 610 formed in the bypass passage 552 when the rod is threaded all the way into the bore 604. The bypass valve 538 can be opened, using a screwdriver or the like, by unscrewing the rod from the valve unit 434 until the tip 608 separates from the seat 610 to open the bypass passage 552, hence bypassing the control valves 530 and 532 and permitting free flow through the valve assembly 532 at all times.

The system as thus-far described is sensitive to fluid expansion and retraction resulting from temperature changes. If the cylinder 438 is filled with fluid at 70° F. with no air in the system, the pressure in the cylinder 438 becomes higher than the working pressure of the seals at 120° F. At 20° F., the fluid contracts to the point that the pressure in the cylinder 438 is below 0 psi. This contraction forms a void in the cylinder 438 and allows the cylinder to move back and forth without fluid flow. The cylinder 438 thus becomes loose and acts as if there is air in the system.

Referring again to FIG. 19, this problem is avoided by providing a thermal compensator 620 (not shown in the remaining drawings) in passage 474 to accommodate thermal expansion and contraction of the fluid. The thermal compensator 620 could be provided in the passage 476 with the same result. The thermal compensator 620 is formed from a reservoir 622, a low pressure check valve 624, and a high pressure relief valve 626. The low pressure check valve 624 operates at less than 5 psi to permit make up fluid to flow into the cylinder 438 from the reservoir 622. The high pressure relief valve is 626 is set at a pressure just above the maximum operating pressure of the system. When the temperature increases, the fluid pressure to above the opening pressure of valve 626, the valve 626 opens and oil flows into the reservoir 622. When the temperature decreases, fluid is drawn back into the system through the low pressure check valve 624. The cylinder 438 therefore remains full of fluid at all times and has no free movement.

One potential drawback of a cable actuated system is the fact that cables act as springs. That is, as the inner core of a cable is loaded, the outer housing flexes, imposing a biasing force on the inner core. If the control valve opening forces and the resultant resistance to cable actuation decreases significantly upon valve opening or at any time after the control valve opens, the outer sleeve releases the stored potential energy, tending to open the control valve further. Fluid then flows through the control valve at higher rate, causing the cylinder to surge or "chatter". As a result, instead of moving smoothly at a steady rate, the cylinder moves in series of starts and stops, providing a noticeably "jerky" feel to the operator.

This problem is eliminated or at least greatly alleviated in this embodiment of the invention because the control valve opening force and resultant resistance to cable actuation remain relatively constant during the steering process. This is because the pressure across each of the control valves 530 and 532 is always at least generally equalized. If the chamber 544 or 546 is pressurized because of fluid passage through the check valve 534 or 536, a chamber 545 or 547 behind the valve body 554 is pressurized at the same pressure as chamber 544 or 546. The force trying to seat the check valve 578 is equal to the seat area multiplied by the pressure in chamber 544 or 546. The seat area is equal to the area of the bore through the cylinder 574 at the seat 580. The pressure in chamber 545 or 547 acts on the area of the cylinder 574 which is approximately equal to the area of the seat 580. Therefore, the fluid force trying to seat the valve from one end is offset by the fluid force trying to unseat it from the other end. The opening force is equal to the spring force of spring 584.

In use, the steering system 410 assumes the position illustrated in FIGS. 20 and 22A in the absence of the imposition of steering forces on the throttle grip 522. At this time, the throttle grip 522 assumes its center or neutral position, and both control valves 530 and 532 assume their closed position of FIG. 22A. Fluid flow between the chambers 442 and 444 in the cylinder 438 is blocked by the closed control valves 530 and 532, hence locking the piston cylinder 438 from moving. This locking prevents steering arm motion and assures that the tiller 426 and engine 420 retain their position despite the imposition of reaction or backlash forces on or by the engine 420.

Assuming now that the operator wishes to turn the boat in direction "A" of FIG. 21, he or she pivots the throttle grip 522, thereby causing the actuator block 502 to rock about point 512 and pull the inner core 494 of the cable 490 away from the valve unit 434 and open control valve 532 as seen in FIG. 22B. Additional throttle grip pivoting drives the tiller arm 480 and steering arm 428, hence pivoting the engine 420 about its support 422 and altering the steering angle of the rudder 424. This steering arm movement also drives the cylinder 438 in the direction of arrow A, forcing fluid from the chamber 442 of the cylinder 438. Fluid then flows through the passage 474 and into the port 470, through the control valve 532, and into the passage 550. The resulting fluid pressure in the passage 550 opens the check valve 534 and permits fluid to flow out of the port 472, through the passages 476, 478, and into the opposite chamber 444 of the cylinder 438.

If the operator releases the throttle grip 522 or even stops applying a steering force to the throttle grip 522, the throttle grip 522 and tiller actuator portion 436 will return to their neutral, center position of FIG. 20 under the force of the spring 514. The check valve 534 will then close under the force of the return spring 600. The check 578 of control valve 532 will likewise close under the closing force imposed by the return spring 582. Fluid flow through the valve assembly 432 is now blocked, preventing the cylinder 438 from moving and locking the engine 420 and its rudder 424 in that last-commanded steering angle.

When the operator wishes to steer the boat 412 in the opposite direction, the above operation occurs in the same way but in the opposite direction. Hence, the operator pivots the throttle grip 522 in the direction "B" in FIG. 21 to pivot the actuator block 502 clockwise about pivot point 510 to open the control valve 530 through the cable 492. Fluid then flows from the chamber 444 in the cylinder 438, through the port 472 of the valve unit 434, through the open control valve 530, and into passage 550, where it opens the valve 536. The fluid then flows through the valve 536, out of the port 470 of the valve unit 434, through the passage 474, and into the opposite chamber 442 of the cylinder 438.

Hence, regardless of the direction of throttle grip movement, one of the valves 530 or 532 is opened mechanically by an associated cable 492 or 494.

Tiller actuation may be resisted or assisted by reaction forces imposed on or by the engine 420. For instance, if motor torque tends to move cylinder 438 in direction B, a pressure is generated in chamber 444. When the operator imposes sufficient force to overcome the torque, the pressure in chamber 444 is reduced to zero. The throttle grip 522 is moved in direction A. Valve 532 is opened. Increased force by the operator then creates a pressure in chamber 442. This pressure opens check valve 534 and fluid flows from chamber 442 into chamber 444. The check valve 534 therefore prevents only back flow of fluid. However, if the operator decreases the actuating force to a point where the engine torque is greater than the applied steering force, the pressure in chamber 444 will overcome the pressure in the cross passage 550, closing the check valve 534 and blocking fluid flow out of the chamber 444. The tiller 426 and engine 420 are thereafter hydraulically locked from further motion unless the operator moves the tiller further.

Conversely, if the engine torque creates a pressure in chamber 444, and the operator wants to steer with the engine torque, he or she moves the throttle grip 522 with only enough force to pivot the actuator block 486 sufficiently to cause the cable 492 to open the valve 530, at which time the engine torque will drive the cylinder 438 to the left and cause fluid to flow from the chamber 444, through the valve assembly 432 via the valves 530 and 536, into the opposite chamber 442. Again, as before, once the operator stops movement of grip 522, the engine torque will return the valve assembly 472 to its neutral position.

It has been discovered that the cable operated valve assembly 432 will also work on powered steering systems such as that discussed above in conjunction with FIG. 15. Specifically, because the opening load of the valves is constant, the "cable spring" effect discussed above is not a problem. The valve assembly therefore can be separated from the tiller and mounted on the cylinder, resulting in a simplified system. This modification would require removing the check valves 534 and 536. One would also have to block off passage 550 that leads to valve 530, remove or close the seat 592, and add a passage from the valve 530 back to a reservoir.

Figure 23:
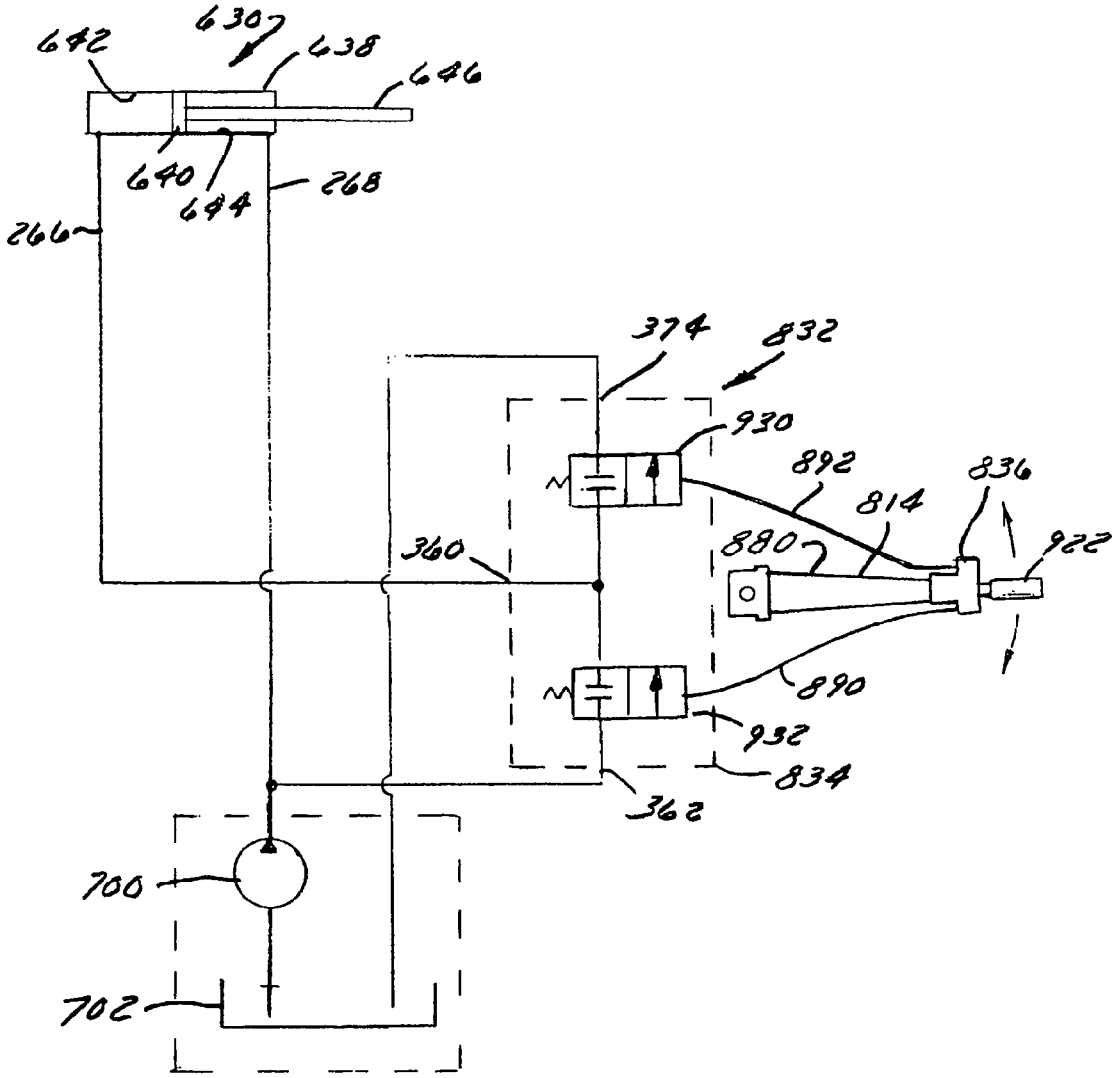
FIG. 23 is a circuit schematic illustrating the construction and operation of the components of a steering system constructed in accordance with yet another embodiment of the invention.

The resultant system is illustrated schematically in FIG. 23. It includes the same unbalanced cylinder 630, pump 700, and reservoir 702 discussed above in connection with FIG. 15. It also includes a valve assembly 832 that is functionally identical to the valve assembly 432 after being modified as discussed in the immediately preceding paragraph. Valve assembly 432 therefore includes an inlet port 362 connected to the pump 700, either directly as shown or via the chamber 638 in the cylinder 630, an outlet port 374 connected to the reservoir 702, and an inlet/outlet port 360 connected to the chamber 642 in the cylinder 630 by the line 266. The valve assembly 832, like the valve assembly 432 described above, includes first and second cable actuated valves 930 and 932. Valves 930 and 932 are actuated by respective cables 892 and 890 upon the articulation of an actuator portion 836 of a tiller 814 under the manual actuation of a throttle grip 922 as described above in connection with the embodiment of FIGS. 16-22B. As with that embodiment, the valve assembly 832 may be provided in a unit 834 that is separated from the tiller 814 and possibly formed integrally with the cylinder 630 as a module. In this case, the line 266 will be wholly interior to the module, and the only exterior ports on the module would be the ports 362 and 374. The resulting system would respond to operator input in the same manner as that discussed above in connection with FIG. 15 and the one disclosed in U.S. Pat. No. 6,715,438.

Many changes and modifications could be made to the invention without departing from the spirit thereof. The scope of some of these changes can be appreciated by comparing the various embodiments as described above. The scope of the remaining changes will become apparent from the appended claims.

I claim:

1. A manually operated steering system for a watercraft, comprising:

(A) a tiller which is configured to be operatively coupled to a steered element of a watercraft so as to impose manually-generated steering forces on the steered element, wherein the steering system is pumpless and at least substantially all steering forces that are applied by the steering system are generated manually;

(B) a hydraulic lock comprising a stationary portion and a movable portion that is configured for connection to the steered element, the movable portion being movable relative to said stationary portion when hydraulic fluid is permitted to flow to or from said hydraulic lock; and (C) a valve assembly which is operatively coupled to said tiller and to said hydraulic lock, said valve assembly 1) being actuated upon manual tiller actuation to permit hydraulic fluid to flow to or from said hydraulic lock and thereby disengage said hydraulic lock and 2) being deactuated in the absence of manual tiller actuation to prevent hydraulic fluid flow to or from said hydraulic lock to thereby engage said hydraulic lock and prevent reaction forces imposed on or by said steered element from being transmitted to said tiller, wherein said valve assembly is contained in a housing attached to said hydraulic lock, wherein said hydraulic lock and said housing are combined in a single module, and wherein the hydraulic lock comprises a hydraulic cylinder assembly comprising a cylinder and a piston that is mounted in said cylinder to define first and second chambers on opposite sides thereof, an end of one said first and second chambers being formed by said housing of said valve assembly.

2. A manually operated steering system for a watercraft, comprising:

(A) a tiller which is configured to be operatively coupled to a steered element of a watercraft so as to impose manually-generated steering forces on the steered element, wherein the steering system is pumpless and at least substantially all steering forces that are applied by the steering system are generated manually;

(B) a hydraulic lock comprising a stationary portion and a movable portion that is configured for connection to the steered element, the movable portion being movable relative to said stationary portion when hydraulic fluid is permitted to flow to or from said hydraulic lock; and (C) a valve assembly which is operatively coupled to said tiller and to said hydraulic lock, said valve assembly 1) being actuated upon manual tiller actuation to permit hydraulic fluid to flow to or from said hydraulic lock and thereby disengage said hydraulic lock and 2) being deactuated in the absence of manual tiller actuation to prevent hydraulic fluid flow to or from said hydraulic lock to thereby engage said hydraulic lock and prevent reaction forces imposed on or by said steered element from being transmitted to said tiller, wherein said valve assembly is contained in a housing attached to said hydraulic lock, wherein said hydraulic lock and said housing are combined in a single module, and wherein the hydraulic lock comprises a hydraulic cylinder assembly comprising a cylinder and a piston that is mounted in said cylinder to define first and second chambers on opposite sides thereof, and wherein said first and second chambers are connected to said valve assembly solely by internal fluid passages in said module.

3. A manually operated steering system for a watercraft, comprising:

(A) a tiller which is configured to be operatively coupled to a steered element of a watercraft so as to impose manually-generated steering forces on the steered element, wherein the steering system is pumpless and at least substantially all steering forces that are applied by the steering system are generated manually;

(B) a hydraulic lock comprising a stationary portion and a movable portion that is configured for connection to the steered element, the movable portion being movable relative to said stationary portion when hydraulic fluid is permitted to flow to or from said hydraulic lock; and (C) a valve assembly which is operatively coupled to said tiller and to said hydraulic lock, said valve assembly 1) being actuated upon manual tiller actuation to permit hydraulic fluid to flow to or from said hydraulic lock and thereby disengage said hydraulic lock and 2) being deactuated in the absence of manual tiller actuation to prevent hydraulic fluid flow to or from said hydraulic lock to thereby engage said hydraulic lock and prevent reaction forces imposed on or by said steered element from being transmitted to said tiller, wherein said tiller comprises an actuator portion which is movable relative to another portion of said tiller upon manual tiller actuation to open said valve assembly, and wherein said valve assembly comprises first and second control valves that are configured to be actuated by said actuator portion of said tiller such that 1) both said first and second control valves remain closed in the absence of actuator portion movement, 2) movement of said actuator portion in a first direction from a neutral position thereof opens at least said first control valve, and 3) movement of said actuator portion in a second direction from said neutral position thereof opens at least said second control valve, further comprising first and second bypass passages having first and second spring-loaded check valves, respectively, each of said check valves opening whenever a pressure differential thereacross exceeds a designated threshold.

4. A manually operated steering system for a watercraft, comprising:

(A) a tiller which is configured to be operatively coupled to a steered element of a watercraft so as to impose manually-generated steering forces on the steered element;

(B) a hydraulic lock comprising a stationary portion and a movable portion that is configured for connection to the steered element, the movable portion being movable relative to said stationary portion when hydraulic fluid is permitted to flow to or from said hydraulic lock; and (C) a valve assembly which is operatively coupled to said tiller and to said hydraulic lock, said valve assembly 1) being actuated upon manual tiller actuation to permit hydraulic fluid to flow to or from said hydraulic lock and thereby disengage said hydraulic lock and 2) being deactuated in the absence of manual tiller actuation to prevent hydraulic fluid flow to or from said hydraulic lock to thereby engage said hydraulic lock and prevent reaction forces imposed on or by said steered element from being transmitted to said tiller, wherein the valve assembly includes a first control valve having an inlet in fluid communication with a first chamber in said hydraulic lock and an outlet in fluid communication with a first bypass passage that is in fluid communication with a second chamber in said hydraulic lock, and a second control valve having an inlet in fluid communication with said second chamber in said hydraulic lock and an outlet in fluid communication with a second bypass passage that is in fluid communication with said first chamber in said hydraulic lock, further comprising first and second spring-loaded check valves in said first and second bypass passages, each of said check valves opening whenever a pressure differential thereacross exceeds a designated threshold.

5. A manually operated steering system for a watercraft, comprising:

(A) a tiller which is configured to be operatively coupled to a steered element of a watercraft so as to impose manually-generated steering forces on the steered element, wherein the steering system is pumpless and at least substantially all steering forces that are applied by the steering system are generated manually;

(B) a hydraulic lock comprising a stationary portion and a movable portion that is configured for connection to the steered element, the movable portion being movable relative to said stationary portion when hydraulic fluid is permitted to flow to or from said hydraulic lock; and (C) a valve assembly which is operatively coupled to said tiller and to said hydraulic lock, said valve assembly 1) being actuated upon manual tiller actuation to permit hydraulic fluid to flow to or from said hydraulic lock and thereby disengage said hydraulic lock and 2) being deactuated in the absence of manual tiller actuation to prevent hydraulic fluid flow to or from said hydraulic lock to thereby engage said hydraulic lock and prevent reaction forces imposed on or by said steered element from being transmitted to said tiller, wherein said tiller comprises an actuator portion which is movable relative to another portion of said tiller upon manual tiller actuation to open said valve assembly, wherein said valve assembly comprises first and second control valves that are configured to be actuated by said actuator portion of said tiller such that 1) both said first and second control valves remain closed in the absence of actuator portion movement, 2) movement of said actuator portion in a first direction from a neutral position thereof opens at least said first control valve, and 3) movement of said actuator portion in a second direction from said neutral position thereof opens at least said second control valve, and wherein the valve assembly further comprises a bypass valve that is manually openable to permit hydraulic fluid to flow through said valve assembly in bypass of said first and second valves.

6. A manually operated steering system for a watercraft, comprising:

(A) a tiller which is configured to be operatively coupled to a steered element of a watercraft so as to impose manually-generated steering forces on the steered element, wherein the steering system is pumpless and at least substantially all steering forces that are applied by the steering system are generated manually;

(B) a hydraulic lock comprising a stationary portion and a movable portion that is configured for connection to the steered element, the movable portion being movable relative to said stationary portion when hydraulic fluid is permitted to flow to or from said hydraulic lock; and (C) a valve assembly which is operatively coupled to said tiller and to said hydraulic lock, said valve assembly 1) being actuated upon manual tiller actuation to permit hydraulic fluid to flow to or from said hydraulic lock and thereby disengage said hydraulic lock and 2) being deactuated in the absence of manual tiller actuation to prevent hydraulic fluid flow to or from said hydraulic lock to thereby engage said hydraulic lock and prevent reaction forces imposed on or by said steered element from being transmitted to said tiller, wherein the valve assembly comprises 1) first and second control valves, each of which is fluidly connected to a respective chamber of the hydraulic lock and 2) first and check valves, each of which prevents backflow from a respective chamber of the hydraulic lock.

7. A locking system for a tiller operated steering system of a watercraft, comprising:

a hydraulic lock that is configured to be coupled to a steered element of the watercraft and that is selectively engageable to lock the steered element from movement, wherein fluid flows into and out of the hydraulic lock whenever the hydraulic lock is disengaged and the tiller is being actuated; and an engager that is configured to be responsive to the absence of the imposition of steering forces to the tiller of the watercraft to engage said hydraulic lock in order to prevent forces imposed on or by a steered element of the watercraft from being transmitted to the tiller, wherein the locking system is pumpless, wherein the engager includes a valve assembly including 1) first and second control valves, each of which is fluidly connected to a respective chamber of the hydraulic lock and 2) first and check valves, each of which prevents backflow from a respective chamber of the hydraulic lock.

8. A method comprising:

(A) manually actuating a tiller of a steering system to impose steering forces on a watercraft to steer the watercraft, wherein the steering system is pumpless and at least substantially all steering forces imposed on the watercraft are generated manually;

(B) releasing said tiller sufficiently to remove the steering forces; and (C) in response to the removal of steering forces from the tiller, automatically engaging a hydraulic lock to prevent reaction forces imposed on or by said steered element from being transmitted to said tiller, wherein the locking step comprises closing first and second control valves to prevent fluid from flowing out of respective chambers of the hydraulic lock, and further comprising closing first and second check valves to prevent backflow of fluid from the first and second chambers of the hydraulic lock.

9. A manually operated steering system for a watercraft, comprising:

(A) a tiller which is configured to be operatively coupled to a steered element of a watercraft so as to impose manually-generated steering forces on the steered element;

(B) a hydraulic lock comprising a stationary portion and a movable portion that is configured for connection to the steered element, the movable portion being movable relative to said stationary portion when hydraulic fluid is permitted to flow to or from said hydraulic lock; and (C) a valve assembly which is operatively coupled to said tiller and to said hydraulic lock, said valve assembly 1) being actuated upon manual tiller actuation to permit hydraulic fluid to flow to or from said hydraulic lock and thereby disengage said hydraulic lock and 2) being deactuated in the absence of manual tiller actuation to prevent hydraulic fluid flow to or from said hydraulic lock to thereby engage said hydraulic lock and prevent reaction forces imposed on or by said steered element from being transmitted to said tiller, wherein the valve assembly includes first and second control valves that permit fluid flow out of respective chambers of the hydraulic lock and first and second check valves that permit fluid to flow into the respective chambers of the hydraulic lock but which prevent backflow therefrom.

* * * * *